US011134724B2

(12) United States Patent
Maheshwari et al.

(10) Patent No.: US 11,134,724 B2
(45) Date of Patent: Oct. 5, 2021

(54) ENGINEERED BRA

(71) Applicant: NIKE, Inc., Beaverton, OR (US)

(72) Inventors: Richa Maheshwari, Hillsboro, OR (US); Heidi Vaughan, Lake Oswego, OR (US)

(73) Assignee: NIKE, INC., Beaverton, OR (US)

( * ) Notice: Subject to any disclaimer, the term of this patent is extended or adjusted under 35 U.S.C. 154(b) by 98 days.

(21) Appl. No.: 15/341,759

(22) Filed: Nov. 2, 2016

(65) Prior Publication Data

US 2017/0290376 A1 Oct. 12, 2017

Related U.S. Application Data

(60) Provisional application No. 62/319,128, filed on Apr. 6, 2016.

(51) Int. Cl.

| | |
|---|---|
| ***A41C 3/12*** | (2006.01) |
| ***A41C 3/00*** | (2006.01) |
| ***D04B 21/20*** | (2006.01) |

(52) U.S. Cl.

CPC ..... *A41C 3/12* (2013.01); *A41C 3/0014* (2013.01); *A41C 3/0085* (2013.01); *D04B 21/20* (2013.01); *D04B 21/207* (2013.01)

(58) Field of Classification Search

CPC ..... A41C 3/12; A41C 3/0014; A41C 3/0085; D04B 21/207; D04B 21/20

See application file for complete search history.

(56) References Cited

U.S. PATENT DOCUMENTS 1,327,408 A 1/1920 Schloss et al.
4,869,081 A * 9/1989 Groshens ..... A41D 27/06 66/192

(Continued)

FOREIGN PATENT DOCUMENTS

AU 2013100481 A4 5/2013
CN 202019813 U 11/2011

(Continued)

OTHER PUBLICATIONS

"Genie Sport," www.geniesport.com http://www.geniesport.com/.

(Continued)

*Primary Examiner* — Katharine G Kane

(74) *Attorney, Agent, or Firm* — Shook, Hardy & Bacon L.L.P.

(57) ABSTRACT

An engineered bra having preconfigured lockout and stretch zones with different stretch properties is provided. The different stretch properties may be achieved by adjusting one or more knitting or weaving techniques and/or materials throughout the bra, with at least a first portion of the bra including a common feature between multiple regions. The knit or woven bra may include varying knit or woven structures within the zones, varying the modulus of elasticity of the yarns used to form the zones, and/or varying the modulus of elasticity of the knit or woven material through specific knit stitch orientation or woven technique. In further aspects, different stretch properties correspond to individual yarn placement, integrated knit or woven structures such as channels, pockets, or shaping, and/or additional integrated knit or woven aspects used to create lockout in a first zone and stretch characteristics in an adjacent, second zone.

18 Claims, 17 Drawing Sheets

(56) References Cited

U.S. PATENT DOCUMENTS

| | | | | |
|---|---|---|---|---|
| 5,446,927 | A | 9/1995 | Weldon | |
| 5,820,444 | A | 10/1998 | McGaughey | |
| 5,855,124 | A * | 1/1999 | Donaghy | A41C 3/0014 66/195 |
| 6,287,168 | B1 * | 9/2001 | Rabinowicz | A41C 3/0007 450/156 |
| 6,708,530 | B2 | 3/2004 | Mitchell | |
| 6,739,158 | B2 | 5/2004 | Sciacca | |
| 6,769,358 | B2 | 8/2004 | Jordan | |
| 6,886,367 | B2 | 5/2005 | Mitchell et al. | |
| 7,076,974 | B1 * | 7/2006 | Chen | D04B 21/10 66/195 |
| 7,159,621 | B2 * | 1/2007 | Shannon | A41B 9/001 139/422 |
| 7,546,751 | B2 | 6/2009 | Lutz | |
| 7,614,256 | B2 | 11/2009 | Mitchell | |
| 8,172,782 | B2 | 5/2012 | Rock | |
| 8,235,766 | B2 | 8/2012 | Melarti et al. | |
| 8,257,138 | B2 | 9/2012 | Smith | |
| D668,430 | S | 10/2012 | Martin | |
| 8,381,314 | B2 | 2/2013 | Takamoto et al. | |
| 8,425,275 | B2 | 4/2013 | Noel | |
| 8,480,452 | B2 | 7/2013 | Reinisch et al. | |
| 8,690,634 | B2 | 4/2014 | Heath et al. | |
| 8,790,287 | B2 * | 7/2014 | Evans | A61F 13/041 602/60 |
| 8,827,767 | B2 | 9/2014 | Samoodi | |
| 2002/0022433 | A1 | 2/2002 | Yeung et al. | |
| 2003/0171066 | A1 * | 9/2003 | Mitchell | A41C 3/0014 450/66 |
| 2004/0003629 | A1 * | 1/2004 | Mitchell | A41C 3/0014 66/179 |
| 2004/0098784 | A1 | 5/2004 | Desai | |
| 2004/0168479 | A1 * | 9/2004 | McMurray | D02G 3/326 66/202 |
| 2004/0237597 | A1 * | 12/2004 | Oya | D04B 21/18 66/195 |
| 2004/0242120 | A1 | 12/2004 | Warren et al. | |
| 2005/0005340 | A1 | 1/2005 | Roux et al. | |
| 2006/0155226 | A1 * | 7/2006 | Grim | A61F 13/041 602/6 |
| 2006/0243000 | A1 | 11/2006 | Turlan et al. | |
| 2007/0238392 | A1 * | 10/2007 | Starbuck | A41C 3/0014 450/1 |
| 2008/0261490 | A1 * | 10/2008 | Scheininger | A41C 3/12 450/39 |
| 2013/0254971 | A1 | 10/2013 | Galluzzo et al. | |
| 2014/0017977 | A1 | 1/2014 | Horii et al. | |
| 2014/0162531 | A1 | 6/2014 | Mazourik et al. | |
| 2014/0256222 | A1 | 9/2014 | Silver et al. | |
| 2014/0366585 | A1 * | 12/2014 | Shen | A41D 13/0015 66/175 |
| 2016/0242472 | A1 * | 8/2016 | Turlan | A41C 3/0007 |
| 2016/0263857 | A1 * | 9/2016 | Mueller | D04B 1/102 |

FOREIGN PATENT DOCUMENTS

| | | | |
|---|---|---|---|
| CN | 202958837 | U | 6/2013 |
| CN | 204132422 | U | 2/2015 |
| CN | 204728045 | U | 10/2015 |
| CN | 105063870 | A | 11/2015 |
| EP | 1275313 | B1 | 1/2007 |
| FR | 2925260 | A3 | 6/2009 |
| GB | 524307 | A | 8/1940 |
| JP | H10131007 | A | 5/1998 |
| JP | 2002309404 | A | 10/2002 |
| JP | 2005200796 | A | 7/2005 |
| JP | 2006283250 | A | 10/2006 |
| TW | M482283 | U | 7/2014 |
| TW | M507185 | U | 8/2015 |
| TW | M518475 | U | 3/2016 |
| WO | 2012133397 | A1 | 10/2012 |

OTHER PUBLICATIONS

"Endurance Racer Sports Bra," www.fastyla.com http://www.fastyla.com/moving-comfort/white-endurance-racer-sports-bra-women-plus-p-63521.html.

International Search Report and Written Opinion dated Feb. 1, 2017 in International Patent Application No. PCT/US2016/060260, 12 pages.

International Preliminary Report on Patentability dated Oct. 18, 2018 in International Patent Application No. PCT/US2016/060260, 9 pages.

Notice of Allowance received for Canadian Patent Application No. 3018548, dated Apr. 29, 2020, 1 page.

Office Action received for European Patent Application No. 16809560.2, dated Apr. 16, 2020, 5 pages.

Office Action dated Jun. 4, 2019 in Canadian Patent Application No. 3,018,548, 3 pages.

Communication pursuant to Article 94(3) dated Jul. 18, 2019 in European Patent Application No. 16809560.2, 4 pages.

Office Action received for European Patent Application No. 16809560.2, dated Oct. 21, 2020, 4 pages.

Office Action received for European Patent Application No. 16809560.2, dated Apr. 22, 2021, 5 pages.

* cited by examiner

476

| | 478 BARS | 482 Fiber | 486 STRAPS | 488 CUP | 490 CHESTBAND | 492 Lapping |
|---|---|---|---|---|---|---|
| | | | 484 BRA ZONES | | | |
| BARS USED | | | 3 | 3 | 4 | |
| YARNS (478) | A1 | 50/72 polyester | x | x | x | 1x1 |
| | A2 | 50/72 polyester | x | x | x | 1x1 |
| | B1 | 30/36 | x | x | x | 1x3 |
| | B2 | 70d spandex | x(Pillar) | x(Pillar) | x(Pillar) | Pillar |
| | B3 | 30/36 polyester | - | - | x | Lay In |

*FIG. 23.*

ENGINEERED BRA

PRIORITY CLAIM

This application claims priority to U.S. Provisional Patent Application No. 62/319,128, filed Apr. 6, 2016, entitled "Engineered Bra,", the entire contents of which is hereby incorporated by reference.

FIELD

The present disclosure relates to an engineered bra.

BACKGROUND

A bra may contain different functional regions that are accomplished through integration of a variety of discrete materials with a variety of manufacturing techniques to achieve each of the different functional regions. For example, separate portions of a bra may be individually cut from different material sources to eventually be stitched and/or adhered together to form the bra.

BRIEF DESCRIPTION OF THE DRAWINGS

Examples of various aspects are described in detail below with reference to the attached drawing figures, wherein:

FIG. 23 is a chart depicting fiber content and stitch construction for one example of an engineered knit bra, in accordance with an aspect herein.

DETAILED DESCRIPTION

Figure 1:
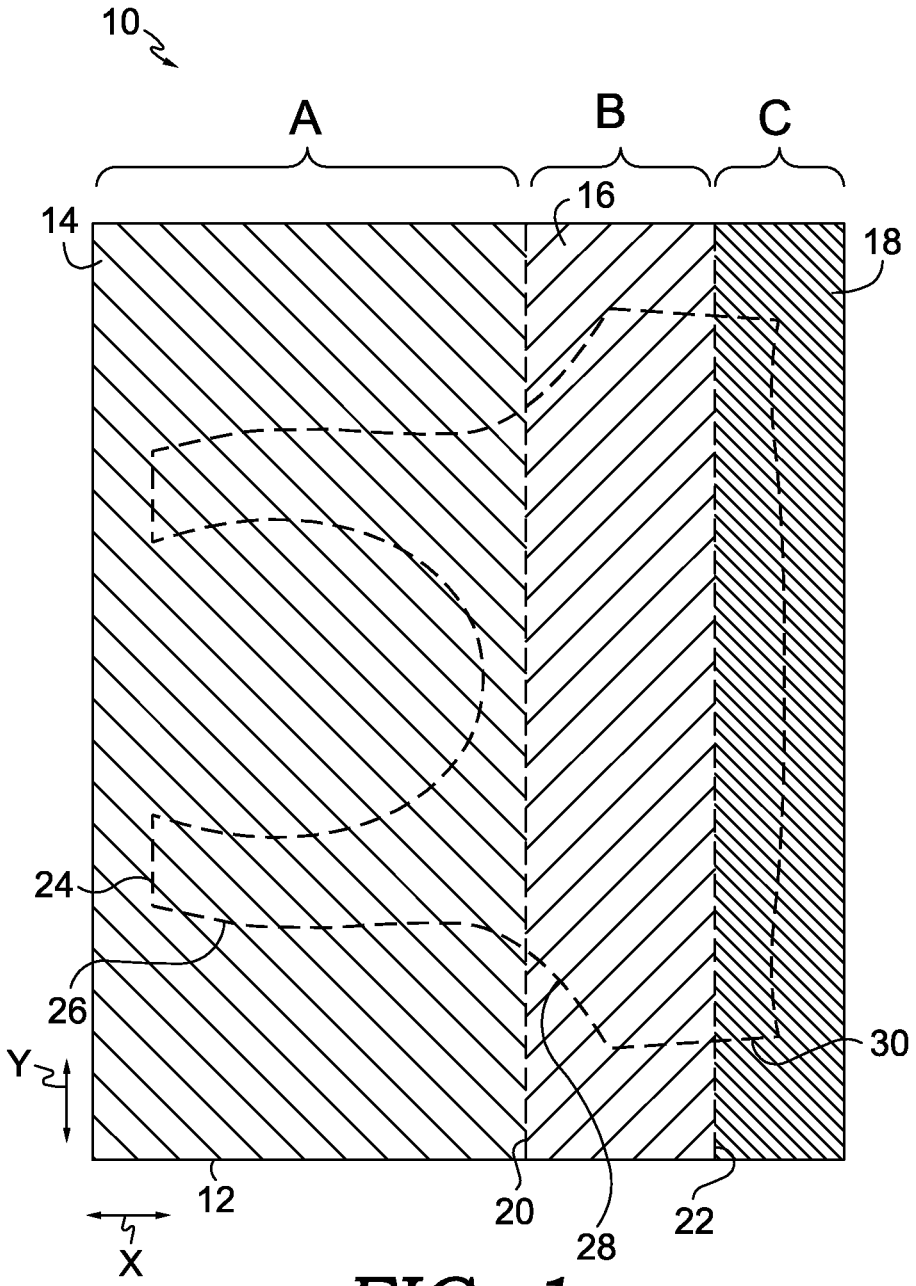
FIG. 1 illustrates a top view of an exemplary engineered knit bra material having preconfigured lockout and stretch zones, in accordance with an aspect herein.

The subject matter of various aspects is described with specificity to meet statutory requirements, but the description itself is not intended to limit the scope of this disclosure. It is contemplated that the subject matter of this disclosure might also be embodied in other ways, to include different steps or combinations of steps similar to the ones described in this document, in conjunction with other present or future technologies. While the terms "step" and/or "block" might be used to connote different elements of methods employed, the terms should not be interpreted as implying any particular order among or between various steps unless and except when the order of individual steps is explicitly stated.

The present disclosure generally relates to an engineered bra. The engineered bra may have preconfigured lockout and stretch zones, where the amount of lockout or stretch associated with each zone depends on engineered knit and/or woven features, such as specific stitches or construction techniques that modify the stretch properties of each zone. For example, aspects herein relate to an engineered bra formed from a unitary panel of knitted or woven material and having preconfigured lockout and stretch zones with different stretch properties. Multiple lockout and stretch zones may be formed in, and spaced adjacently across, the unitary panel. The engineered bra is cut (e.g., stamped, extracted, separated, and/or removed) from the unitary panel such that different regions of the engineered bra are formed from different zones of the unitary panel, in accordance with some aspects. For example, it may be desirable for bust and back regions of the engineered bra to provide compression on a wearer while permitting stretch when the engineered bra is in the as-worn configuration and may therefore be cut from the stretch zones of the unitary panel. It may not be desirable for the chest band and shoulder strap regions of the engineered bra to stretch as much as the bust and back regions, and may therefore be cut from lockout zones of the unitary panel. Forming the engineered bra from a unitary panel of knitted or woven material may reduce the number of bonding or seaming points and material waste. In some aspects, the engineered bra has two seams along its sides while still providing lockout and stretch zones in the different regions, as provided in greater detail hereinafter.

The different stretch properties of the zones may be achieved by adjusting one or more knitting or weaving structures, stitch patterns, weaving techniques, and/or yarn selections throughout the manufacture of the engineered knit or woven bra front, with at least one common feature between adjacent zones (i.e., at least one "unitary" element between different zones having different lockout/stretch characteristics). For example, a lockout zone A may include a particular knit stitch and yarn selection, and upon transition to an adjacent stretch zone B, the particular knit stitch may continue while the selected yarn is changed to a stretch yarn. In this example, a seamless material structure is maintained, with adjacent, knitted zones having different lockout properties and at least one common feature (i.e., the particular knit stitch). In another example, a lockout zone A may include a particular lockout stitch construction that transitions to a different stretch stitch construction in stretch zone B, while maintaining at least one common yarn between the adjacent zones. In yet another example, the common feature between adjacent zones may be one or more of a consistent warp yarn and a consistent weft yarn extending across the adjacent zones. As used herein, a "common feature" refers to a consistent element used across the knitted or woven material, including at least a portion of at least two different zones, as illustrated by the above examples.

In further aspects, the different stretch properties of the zones may be achieved by varying the knit or woven structures within the zones, such as a knit structure or woven structure constructed to provide lockout within the knit or woven material. For example, a knit structure may be varied within the zones to achieve different stretch properties between the zones. Additionally, different stretch properties of the zones may be achieved by varying the yarn type within and/or between the zones, such as alternating between yarns in particular locations based on the modulus of elasticity of those yarns. A "yarn type" refers to a material content, strand number (e.g., a doubled strand), material formation (e.g. ply, twist), and/or gauge (e.g., denier, tex, diameter, etc.) of a particular yarn, such as a fine-gauge polyester yarn or a bulky-gauge nylon yarn. In one example, a yarn type in a particular bra region may correspond to a particular function within the bra structure, such as a specific yarn type knitted or woven within at least a portion of the stretch zone B to provide a particular support level, material feel, and/or appearance within the cup region of the bra. In some aspects, a yarn type utilized within the stretch zone B may include a lightweight, high-stretch, elastic yarn, or a combination of multiple yarns, that provides resulting material properties with zonal stretch characteristics. Similarly, a different yarn type may be engineered within a different bra region and correspond to a particular function of a different bra structure, such as a specific yarn type knitted or woven within at least a portion of lockout zone A. In some aspects, a yarn type utilized within the lockout zone A may include a heavyweight, low-stretch, non-elastic yarn (i.e., a "hard" yarn), or a combination of multiple yarns, that provides resulting material properties with zonal lockout characteristics.

Further, the overall modulus of elasticity of the knit or woven material may be varied through specific knit stitches or weaving techniques that minimize the elongation of the material fibers in one or more directions (i.e., width-wise, length-wise, or both). The term "elongation" is used to refer to a yarn stretched from a first length to a second length greater than the first length, along the central, longitudinal axis of a yarn. For example, a lockout yarn may be defined as being limited by a maximum amount of elongation, such as a lockout yarn with less than 20% elongation. In another example, a stretch yarn may be defined as stretching within a range of maximum elongation, such as a stretch yarn having a maximum elongation between 50% to 70%. In one aspect, a stretch yarn may be characterized as having a maximum elongation less than 60%. In further aspects, different stretch properties of multiple zones within the engineered bra may correspond to individual yarn placement, integrated knit or woven structures, and/or additional integrated knit or woven aspects used to create lockout in at least one zone and stretch characteristics in an adjacent zone.

The engineered knit or woven bra may be generally characterized as including at least one lockout zone adjacent at least one stretch zone engineered into the material, with the adjacent zones including at least one common feature in a seamless configuration according to some aspects. In one aspect, the engineered bra includes a lockout zone in a strap and chest band region of the bra, and a variable stretch zone in the cup region between the strap and chest band regions. The amount of lockout in the strap and/or chest band region may be adjusted for a desired bra configuration using knit or woven structures, such as specific stitch patterns or weaving techniques utilized within the lockout zones. Further, an amount of lockout may be limited to a single or multiple directions, such as lengthwise lockout in a strap region of a bra, and both lengthwise and widthwise lockout in the chest band region, as discussed in greater detail hereinafter.

In some aspects, a particular yarn inserted in the lockout zones may be knitted or woven to provide a particular characteristic (for example, widthwise lockout) that has a stabilizing effect of minimizing the stretch within the resulting bra and resisting elongation of that lockout zone portion of the bra. In further aspects, the amount of stretch within the stretch zones of the bra may correspond to the engineered features of each zone, such as those engineered using specific knitting or weaving techniques, integrating particular yarn content, and/or including specific support structures or functional features that are knit or woven into the material of the bra. For example, an engineered feature of a stretch zone may include a stretch knit stitch used within at least a portion of the stretch zone, while an engineered feature of a lockout zone may include a lockout knit stitch used within at least a portion of the lockout zone. As used herein, an "engineered feature" may include any yarn-related, knitting-related, or weaving-related aspect for manufacturing the engineered bra material. As such, one example of a change between engineered features within the engineered bra material is a change between stretch stitches and lockout stitches. In a further example, an engineered feature may be associated with a change in yarn tension between a stretch zone and a lockout zone of the bra material. In another aspect, the stitch construction within at least a portion of a knit row may provide a particular stitch spacing, stitch length, length of yarn based on the stitch construction, and/or yarn tension that engineers at least one feature of at least one stretch or lockout zone within the bra.

In some aspects, an engineered feature of the engineered bra may include one or more variations in knitted or woven construction. For example, an engineered feature of a knit bra may include a short float, a long float, a pillar stitch, a chain stitch, a variable tension between adjacent stitches, a variable tension between adjacent rows of knitting, a knit-in additional yarn, a knitting speed increase, a knitting speed decrease, or a combination of the like. As such, an engineered feature of the engineered bra may include a "lockout stitch" characterized by, for example, a short float, or additional/alternative engineered lockout features that restrict stretch of the engineered material. In another example, a "stretch stitch" may be characterized as including a long float, or additional/alternative engineered stretch features that permit stretch of the engineered material. In further aspects, a lockout stitch, a stretch stitch, a yarn tension, a yarn length, a stitch spacing, a stitch-to-needle ratio, a yarn overlapping, a needle skipping, or additional construction techniques or material effects may be adjusted throughout the engineered material knitting.

In further examples, the amount of stretch within a stretch zone of the bra may be controlled by including a specific, integrated structure at a specific location within the stretch zone. Examples of an integrated structure that is integrally knit or woven into an engineered bra material include an integrated channel structure (e.g., an underwire channel), an integrated pocket structure, an integrated adjustment feature, an integrated strap component, an integrated graphic structure (e.g., yarn change), or other integrated textile element incorporated into the engineered material and having an impact on the stretch modulus of at least a portion of the engineered bra. Such integrated structures may include a jacquard structure knitted or woven into the engineered material, such as a jacquard knit structure that inserts additional or alternative yarns into different locations to form graphics, thereby impacting the material stretch modulus. For example, as discussed in more detail below with respect to FIG. 7, a jacquard structure may be used to insert a different yarn into a different location to form graphic element within the bra, such as a graphic element oriented around the cup and strap zones that affects the overall modulus within each zone. In some aspects, an amount of stretch and corresponding compression/support within a portion of the stretch zone of the bra may be changed using integrated structures, such as a change in stretch based on a channel structure for receiving an underwire and/or a cup pocket for receiving a liner.

Such inserted yarns or integrated structures may be applied throughout an entire row of knitting or weaving, or in other aspects, may be incorporated in a particular portion or multiple discrete portions of a single row, which may be referred to as the "zonal" placement of integrated structures. As such, the varied yarn content and engineered support/functional features may dynamically change in a lateral direction across a row of warp knitting or weaving as well as along the width of the knitted or woven material in a direction normal to the lateral direction. For example, lengthwise yarn changes in the warp direction may provide banded, zonal changes along the y axis of the engineered material while at the same time, widthwise changes in knitted or woven structures may provide for additional, zonal changes in lockout or stretch features along the x axis within the bra material. As such, an integrated structure may be positioned at a preconfigured location with respect to the respective support zones (for example, at a particular location within the weft direction and the warp direction of an engineered material).

In further aspects, the method of manufacturing the engineered knit or woven bra may utilize a particular yarn type across an entire length or entire width of an engineered bra material (based on the knitting or weaving technology used) such that yarn selection corresponds to a series of knit or woven rows in a lockout zone or a series of knit or woven rows in a stretch zone (i.e., a band of yarn content, lengthwise or widthwise). In addition to the banded yarn content, zonal changes in integrated knit or woven structures may alter the zonal stretch and/or zonal lockout characteristics within each lockout zone and each stretch zone. For example, a stretch zone having a stretch yarn carried across the entire width of the engineered material may have a particular stretch characteristic spanning the width of the stretch zone, as derived from yarn characteristics (i.e., the "engineered feature" being stretch yarn selection), while at the same time having particular stretch characteristics in zonal locations associated with integrated structures. In other words, while the engineered stretch yarn may continue across the stretch zone, the additional characteristics provided by integrated knit or woven structures may impact a portion of the bra in the particular stretch zone. In yet another example, the engineered lockout yarn used to generate lockout in a particular lockout zone (i.e., the "engineered feature" of lockout yarn selection), as carried across an entire lockout zone, may further provide additional lockout characteristics that correspond to particular integrated knit or woven structures impacting a portion of the lockout zone.

Accordingly, one or more zonal stretch characteristics corresponding to engineered yarn type and/or integrated structure placement may correspond to a particular function of a particular part of the bra (e.g., a stretch zone within a bra cup region may include enhanced stretch based on integrated structures knitted or woven at particular positions), while maintaining a common stretch yarn content across the width of the bra (i.e., even though a portion of the stretch zone may include integrated structures. For example, a same yarn may be knitted or woven throughout an entire lockout zone, with a change in stitch construction or weaving technique that alters the lockout properties of a portion of that particular zone. Similarly, a same yarn may be knitted or woven throughout an entire stretch zone, with a change in stitch construction or weaving technique that alters the stretch properties of a portion of that particular zone. As used here, a zonal or organic placement of an integrated structure refers to an integrated structure knitted or woven in a particular portion of the engineered material, such as a zonal integrated structure providing a specific function at a particular location without spanning the entire width of the knit or woven material.

Aspects herein may further relate to a method of manufacturing an engineered knit or woven bra. The method may include, for example, knitting an engineered knit bra material having engineered features and integrated knit structures that provide targeted lockout zones having a desired support and function throughout the engineered knit bra. In further aspects, the method may include weaving an engineered woven bra material having engineered features and integrated woven structures that provide targeted lockout zones having a desired support and function throughout the engineered woven bra. The method may also include cutting the engineered bra from the knitted or woven material such that the chest band and shoulder strap regions are cut from lockout zones and the bust and back regions are cut from stretch zones. In one aspect, the method may include cutting the engineered bra from the knitted or woven material in a widthwise or in a lengthwise orientation. As such, depending on the type of knitting or weaving machine used to create the engineered knit or woven material, the lockout zones and stretch zones may be knitted or woven with yarns carried in particular directions (e.g., according to the specifications/capabilities of the knitting or weaving machine). For example, in a warp knitting machine, banded yarn configurations in a warp-knitting direction may provide lockout zones and stretch zones carried across a length or width of the engineered knit bra and may correspond to the particular yarns used at particular positions by the warp knitting machine. In one example, an engineered bra pattern may be cut out from an engineered material in a cross-grain orientation, such that the banded orientation of warp yarns forms lateral bands of lockout and stretch properties along the body of the engineered bra front, as shown in FIG. 1. In another example, an engineered bra pattern may be cut out along the material grain, with the orientation of warp yarns forming vertical bands in a direction perpendicular to the bra band.

The method may further include joining lower side edges of the front and back of the engineered bra at a left seam and at a right seam. Additional steps may include finishing or molding the bra, such as applying an overlay feature or heat-treating at least a portion of the stretch cup region, as provided in greater detail hereinafter. As used herein, an "overlay" feature means a feature placed at a surface of the material comprising the engineered bra and affixed to the engineered bra through a treatment process.

Accordingly, one aspect is directed to an engineered bra comprising a plurality of engineered support zones, wherein each of the plurality of support zones has a modulus of elasticity value within a predefined range, and wherein each of the plurality of support zones comprises one or more engineered features that modify the modulus of elasticity value of at least a portion of the respective support zone. In one example, a predefined range for a modulus of elasticity value may include a modulus of elasticity between three to ten newtons (N), while in another example, a predefined range of modulus of elasticity may be between five and eight N. Additionally, the engineered bra comprises, in an exemplary aspect, a common yarn comprising one or more of a consistent warp yarn and/or a consistent weft yarn extending across the plurality of support zones, such that at least one of the one or more engineered features of a first support zone comprises the same common yarn as at least one of the one or more engineered features of a second support zone adjacent the first support zone.

In another aspect, an engineered bra comprises a first support zone having a first modulus of elasticity value within a predefined range, the first support zone located at a lower front portion of the bra (e.g., inferior and anterior location of the bra when in an as-worn configuration). The engineered bra further comprises a second support zone having a second modulus of elasticity value within a predefined range, the second support zone located at a middle front portion of the bra and adjacent to the first support zone. In further aspects, the engineered bra comprises a third support zone having a third modulus of elasticity value within a predefined range, the third support zone located at an upper front portion of the bra (e.g., superior and anterior location of the bra when in an as-worn configuration) and adjacent to the second support zone, wherein each of the first, second, and third support zones comprises one or more engineered features that modify the modulus of elasticity value of the respective support zone, and further wherein a common yarn extends across the first, second, and third support zones.

According to another aspect, the engineered bra comprises a first support zone having a first modulus of elasticity value within a predefined range, and a second support zone oriented adjacent the first support zone, said second support zone having a second modulus of elasticity value within a predefined range, wherein the second modulus of elasticity value is greater than the first modulus of elasticity value. The engineered bra further comprises a third support zone oriented adjacent the second support zone, said third support zone having a third modulus of elasticity value within a predefined range. In an example, the third modulus of elasticity value is the same as the first modulus of elasticity value, wherein the modulus of elasticity of the first, second, and third support zones corresponds to an engineered knit feature or an engineered woven feature of the respective first, second, and third support zones.

In some aspects, an engineered bra includes a first knit zone that exhibits a first modulus of elasticity within a predefined range along a first direction and a second modulus of elasticity within a predefined range along a second direction, where the first knit zone includes a first plurality of warp-knitted yarns forming a pair of engineered bra straps. The engineered bra further includes a second knit zone that exhibits a third modulus of elasticity within a predefined range along the first direction and a fourth modulus of elasticity within a predefined range along the second direction, with the second knit zone adjacent the first knit zone and comprising a second plurality of warp-knitted yarns forming an engineered bra cup, wherein a yarn of the second plurality is interlocked with a yarn of the first plurality. Additionally, the engineered bra includes a third knit zone that exhibits a fifth modulus of elasticity within a predefined range along the first direction and a sixth modulus of elasticity within a predefined range along the second direction, with the third knit zone adjacent the second knit zone and comprising a third plurality of warp-knitted yarns and at least one inlaid yarn, said third plurality of warp-knitted yarns and said at least one inlaid yarn forming an engineered bra band, wherein a yarn of the third plurality is interlocked with a yarn of the second plurality.

Additional engineered bras include, in some aspects, a knitted strap zone comprising a pair of bra straps having a strap width and a strap length, wherein the strap zone comprises a plurality of strap zone yarns knitted with a strap non-lockout gauge in a first direction and a strap lockout gauge in a second direction, the strap width having a modulus of elasticity greater than a modulus of elasticity of the strap length. The engineered bra further includes a knitted cup zone comprising a plurality of cup zone yarns knitted with a cup non-lockout gauge in a first direction and a cup non-lockout gauge in a second direction, wherein a yarn of the plurality of strap zone yarns is interlocked with a yarn of the plurality of cup zone yarns. Still further, the engineered bra includes a knitted chestband zone comprising a plurality of chestband zone yarns knitted with a chestband lockout gauge in a first direction and a chestband lockout gauge in a second direction, wherein a yarn of the plurality of chestband zone yarns is interlocked with a yarn of the plurality of cup zone yarns, and further wherein the plurality of chestband zone yarns comprises an inlaid hard yarn that minimizes elongation within the chestband zone relative to the cup zone, wherein each of the plurality of strap zone yarns, cup zone yarns, and chestband yarns comprises a face yarn having a first denier per filament (DPF) ratio and a back yarn having a second DPF ratio lower than the first DPF ratio, wherein the face yarn comprises a 1×1 lapping structure, the back yarn comprises a 1×3 lapping structure, and a spandex yarn knitted in a pillar stitch configuration within each knit zone.

As such, the disclosure contemplates a variety of engineered bra configurations having lockout and/or stretch zones relative to one another, and in some instances, different directions of lockout and/or stretch characteristics based on the knitted construction of the engineered bra. The variations within each stretch zone may be adjusted through a variety of techniques, such as material selection, manufacturing process (e.g., knit features, woven features, inlaid features), construction technique (e.g., knit stitch selection/location, inlaid yarn insertion point), and the like. The figures and associated discussion provide additional details on the variety of engineered bra configurations contemplated herein. Additionally, although illustrated as providing lockout and/or stretch zones that span a width of the material in a banded configuration, it is contemplated that the engineered bra may include additional or alternative zonal placement of lockout and/or stretch zones.

Accordingly, in one aspect, an engineered bra comprises: a first knit zone that exhibits a first modulus of elasticity within a predefined range along a first direction and a second modulus of elasticity within a predefined range along a second direction, said first knit zone comprising a first plurality of warp-knitted yarns forming a pair of engineered bra straps; a second knit zone that exhibits a third modulus of elasticity within a predefined range along the first direction and a fourth modulus of elasticity within a predefined range along the second direction, said second knit zone adjacent the first knit zone and comprising a second plurality of warp-knitted yarns forming an engineered bra cup, wherein a yarn of the second plurality is interlocked with a yarn of the first plurality; and a third knit zone that exhibits a fifth modulus of elasticity within a predefined range along the first direction and a sixth modulus of elasticity within a predefined range along the second direction, said third knit zone adjacent the second knit zone and comprising a third plurality of warp-knitted yarns and at least one inlaid yarn, said third plurality of warp-knitted yarns and said at least one inlaid yarn forming an engineered bra band, wherein a yarn of the third plurality is interlocked with a yarn of the second plurality.

In another aspect an engineered bra comprises: a knitted strap zone comprising a pair of bra straps having a strap width and a strap length, wherein the strap zone comprises a plurality of strap zone yarns knitted with a strap non-lockout gauge in a first direction and a strap lockout gauge in a second direction, the strap width having a modulus of elasticity greater than a modulus of elasticity of the strap length; a knitted cup zone comprising a plurality of cup zone yarns knitted with a cup non-lockout gauge in a first direction and a cup non-lockout gauge in a second direction, wherein a yarn of the plurality of strap zone yarns is interlocked with a yarn of the plurality of cup zone yarns; and a knitted chestband zone comprising a plurality of chestband zone yarns knitted with a chestband lockout gauge in a first direction and a chestband lockout gauge in a second direction, wherein a yarn of the plurality of chestband zone yarns is interlocked with a yarn of the plurality of cup zone yarns, and further wherein the plurality of chestband zone yarns comprises an inlay hard yarn that minimizes elongation within the chestband zone relative to the cup zone, wherein each of the plurality of strap zone yarns, cup zone yarns, and chestband yarns comprises a face yarn having a first denier per filament (DPF) ratio and a back yarn having a second DPF ratio lower than the first DPF ratio, wherein the face yarn comprises a 1×1 lapping structure, the back yarn comprises a 1×3 lapping structure, and a spandex yarn knitted in a pillar stitch configuration within each knit zone.

In a further example, an engineered bra comprises: a strap zone having a plurality of strap zone yarns warp knitted in the engineered bra to provide a first stretch modulus in a first direction and a second stretch modulus in a second direction, said plurality of strap zone yarns comprising front yarn content and back yarn content; a cup zone having a plurality of cup zone yarns warp knitted in the engineered bra to provide a third stretch modulus in the first direction and a fourth stretch modulus in the second direction, said plurality of cup zone yarns comprising 1×1-lapped front yarn content and 1×3-lapped back yarn content; a chestband zone having a plurality of chestband zone yarns warp knitted in the engineered bra to provide a fifth stretch modulus in the first direction and a sixth stretch modulus in the second direction, said plurality of chestband zone yarns comprising 1×1-lapped front yarn content, 1×3-lapped back yarn content, and a laid-in hard yarn, wherein a strap zone yarn is interlocked with a cup zone yarn, and a cup zone yarn is interlocked with a chestband zone yarn.

Referring initially to the exemplary top view of FIG. 1, an engineered knit bra 10 may be cut from a material 12 that includes multiple, preconfigured lockout and stretch zones that vary the stretch characteristics throughout the material 12. For example, the material 12 may include one or more lockout zones and one or more stretch zones. It is contemplated that there may be different lockout characteristics between multiple lockout zones. It is also contemplated that there may be different stretch characteristics between multiple stretch zones. Therefore, herein different characteristic zones may be referred to by letter identification while different physical zones may be referred to by numerical identification. For example, a common bra may include two (or more) lockout zones (e.g., first zone14 and third zone 18) with each of the lockout zones having a different lockout characteristic (e.g., A and C, respectively). Similarly, a stretch zone (e.g., a second zone 16) may have a stretch characteristic (e.g., B). As such, it is contemplated that multiple zones may share a common characteristic in an exemplary aspect. Additionally or alternatively, a common zone may have multiple characteristics.

In the example of FIG. 1, the engineered knit bra 10 may be cut from the material 12 such that a first portion of the engineered knit bra 10 is cut from the first zone 14, a second portion of the engineered knit bra 10 is cut from the second zone 16, and a third portion of the engineered knit bra 10 is cut from the third zone 18. As such, the exemplary bra of FIG. 1 is cut across the grain of the material, with the width of the bra (from left wing to right wing) along the y axis and the bra length/height (from bra band to bra strap) oriented along the x axis. With the orientation of the engineered knit bra 10 within the material 12, in one aspect, the lockout and stretch zones of the bra correspond to the warp direction of knitting along the y axis. In another example, the engineered knit bra 10 may be oriented within the material 12 along the weft direction (i.e., with the width of the bra along the x axis), to provide lockout and stretch zones corresponding to a weft direction of knitting along the x axis.

In the example of FIG. 1, the engineered material 12 includes the first zone 14 having lockout A characteristic from knit structure, knit tension, and/or yarn type, the second zone 16 (adjacent first zone 14) having stretch characteristic B from knit structure, knit tension, and/or yarn type, and the third zone 18 (adjacent second zone 16) with lockout characteristic C from knit structure, knit tension, and/or yarn type. The characteristics may be referred to as zones for convenience hereinafter. The lockout zone A may include the same or similar characteristics (i.e., knit structure, knit tension, and/or yarn type) as those associated with lockout zone C, while in other aspects, the lockout zones A and C may include different characteristics. For example, the first zone 14 may include a particular knit structure, knit tension, and/or yarn type that minimize elongation (provides lockout) in the lengthwise direction along the y axis with respect to lockout zone A. Further, the third zone 18 may include a particular knit structure, knit tension, and/or yarn type that minimizes elongation (provides lockout) in the widthwise direction along the x axis as well as in lengthwise direction with respect to lockout zone C. In one example, at least a portion of first zone 14 having lockout zone A characteristics may include a two-ply yarn that requires more force to stretch the yarn than a stretch thermoplastic polyurethane (TPU) yarn in an adjacent, second zone 16 having stretch zone B characteristics.

FIG. 1 is illustrated having a hatch drawn in each of the first zone 14, second zone 16, and third zone 18. The hatch is drawn merely to contrast the varying stretch or lockout characteristics within the material 12 and between adjacent zones, but does not indicate a particular construction or appearance of such zones. Instead, along a boundary 20 between first zone 14 and second zone 16, one or more knit characteristics within the material 12 may be changed to generate a difference in stretch properties between the adjacent zones, such as a low/no stretch yarn associated with at least a portion of the first zone 14 above the boundary 20, and a stretch-knit yarn associated with at least a portion of the second zone 16 below the boundary 20. In one example, a particular knit stitch configuration providing lockout in a lengthwise direction (such as in the direction of the y axis) within the first zone 14 (i.e., having one or more lockout zone A characteristics) may be adjacent the different knit stitch configuration providing four-way stretch (i.e., stretch zone B characteristics, providing stretch along both the x axis and y axis) within the second zone 16. Additionally, in some aspects, a particular knit stitch configuration may provide lockout in both the lengthwise and widthwise directions (i.e., along both the y axis and the x axis) within the third zone 18.

Similar to the boundary between the first and second zones 14 and 16, the boundary 22 between the second zone 16 and the third zone 18 may indicate a change in one or more knit characteristics within the material 12 along the boundary 22 to generate varying stretch properties, such as a stretch-knit stitch associated with at least a portion of the second zone 16 and a particular lockout knit stitch configuration having lockout in both a lengthwise and a widthwise direction within the third zone 18. Although described in this example with respect to knit stitch configuration, additional aspects of the material 12 may include varied stretch properties between adjacent zones that correspond to one or more knit structures, one or more knit tensions, and/or one or more yarn types varied within at least a portion of each zone. For example, a first yarn tension may be applied by a knitting machine within the first zone 14, while a second yarn tension may be applied by a knitting machine within the second zone 16. As used herein, a yarn "tension" refers to an amount of force applied to a yarn in a direction opposite the direction of knitting during a knitting operation.

As depicted in the example of FIG. 1, the first zone 14 may include lockout zone A characteristics that are the same or different from the lockout zone C characteristics of the third zone 18. In other words, a first zone 14 may be characterized as providing lockout, as defined by particular, engineered lockout zone A characteristics, while a third zone 18 may be characterized as providing lockout associated with engineered lockout zone C characteristics. In some aspects, at least a portion of the first zone 14 may include the lockout zone A achieved using the same or similar yarn content as in at least a portion of the third zone 18 having lockout zone C characteristics, such as a different yarn tension applied to the same yarn type knitted into at least a portion of the first zone 14 and third zone 18. With varied engineered features within each lockout zone, in some aspects, the amount of low-stretch, no-stretch, and/or minimized elongation within at least a portion of each lockout zone corresponds to a particular bra structure, such as a bra strap or bra band. In another aspect, the stitch structure and construction techniques of lockout zones A and C within the material 12 may correspond to a widthwise (x axis) and lengthwise (y axis) lockout orientation. For example, the lockout zone A characteristics of first zone 14 may include a particular stitch structure, yarn type, and/or machine-knit construction technique to provide lengthwise lockout associated with the strap region 26. Similarly, the lockout zone C characteristics of the third zone 18 may be characterized as including a particular stitch structure, yarn type, and/or machine-knit construction technique to provide both widthwise and lengthwise lockout associated with a band region 30. In another aspect, lockout zones A and C may include lengthwise and widthwise lockout with respect to the y and x axis, to varying degrees of stretch according to each zone's respective knit structure, tension, and/or yarn type.

In one aspect, an engineered bra front 24 may be constructed within the material 12, with various pattern portions oriented according to one or more lockout zones A and C, and stretch zones B, in this example. In the example of FIG. 1, a strap region 26 may be positioned within the first zone 14 (having particular lockout zone A characteristics), a bust region 28 may be positioned within the second zone 16 (having particular stretch zone B characteristics), and the band region 30 may be positioned within the third zone 18 (having particular lockout zone C characteristics). The first zone 14 may therefore be knitted to include one or more specific yarns, stitches, integrated structures, varying tensions, and/or a combination thereof to provide a lockout zone A at a position corresponding to the strap region 26. Similarly, the second zone 16 may be knitted to include one or more specific yarns, stitches, integrated structures, varying tensions, and/or a combination thereof to provide a stretch zone B at a position corresponding to the bust region 28. Finally, the third zone 18 may be knitted to include one or more specific yarns, stitches, integrated structures, varying tensions, or a combination thereof to provide a lockout zone C at a position corresponding to the band region 30. In one aspect, the strap region 26 within the first zone 14 may include at least a portion of the neckline of the engineered bra front 24, such as an upper portion along the upper edge of the bust region 28. For example, as shown in FIG. 1, the lockout zone A may extend along the straps of the bra front 24 and into a central portion of the bra adjacent the stretch zone B. Such additional lockout in an area around the neckline edge and upper bust of a wearer may provide additional support to a wearer, such as by resisting bounce of a wearer's breasts in an upward direction. Accordingly, while the lockout zone A characteristics associated with the first zone 14 may correspond to a "strap region" within the bra front 24, in some aspects, the lockout zone A characteristics extend beyond the strap length and towards the cups, along the x axis, to provide additional lockout support (e.g., add compression to breast tissue and resist bounce), prior to the transition into the stretch zone B characteristics of the second zone 16.

Although depicted in the example of FIG. 1 as including a first, second, and third zone 14, 16, and 18, in further aspects, fewer or greater numbers of zones having one or more of exemplary characteristics A, B, and/or C may be oriented within the material 12 for providing a corresponding engineered bra front 24. For example, an engineered bra front may include the first zone 14 having lockout zone A characteristics along an upper strap region, and the second zone 16 having stretch zone B characteristics reaching a bottom edge of the bra front 24. In this way, an additional banded structure having stabilizing/lockout aspects may be separately attached to the material 12 of a bra front 24 that may include first and second zones 14 and 16, according to one aspect. Further, the size, orientation, position, and/or order of various lockout zones A and C, and stretch zones B, may also vary between different aspects, such as between different pattern placements of the engineered bra front 24 within the material 12.

Figure 2:
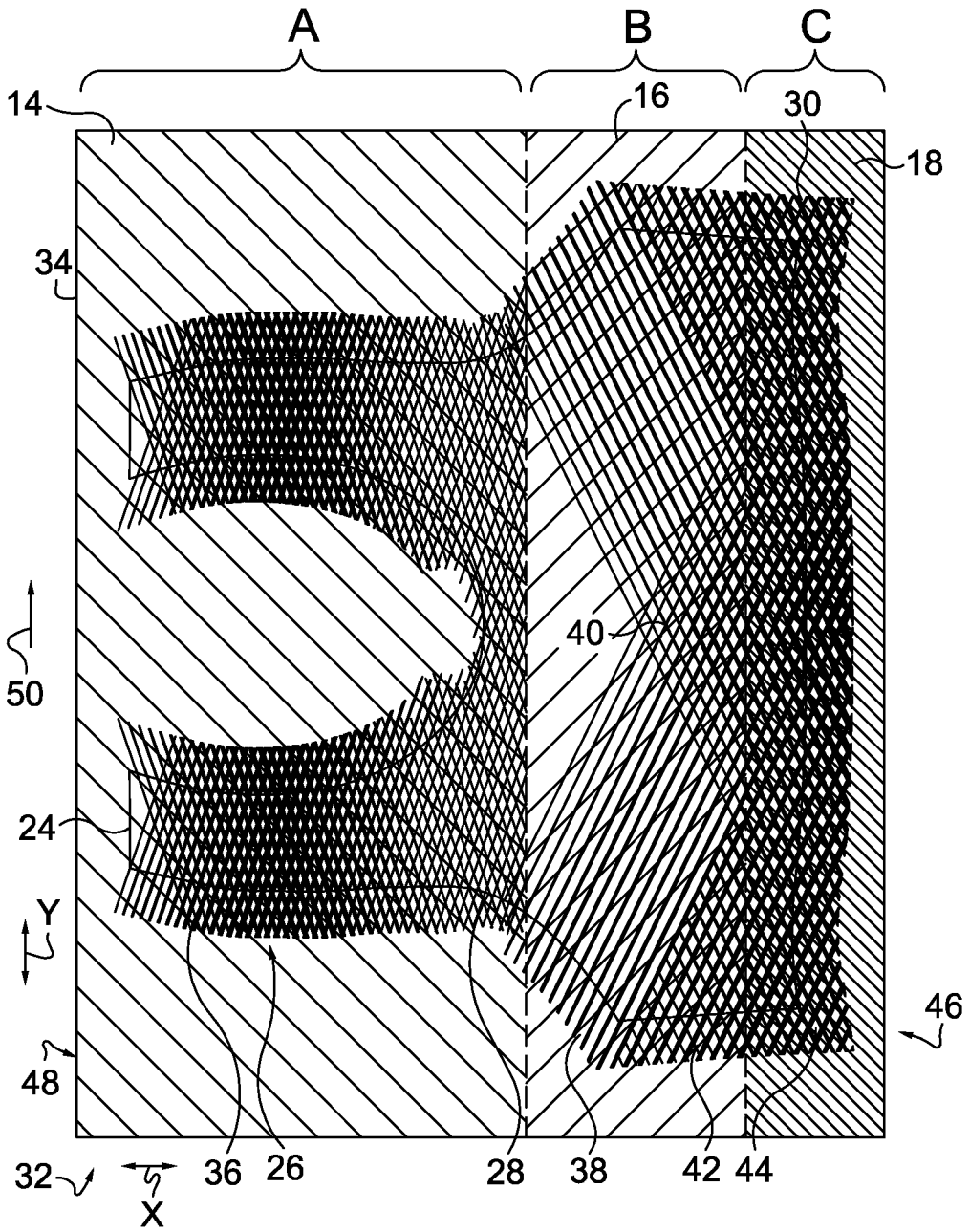
FIG. 2 illustrates a top view of the engineered knit bra material of FIG. 1 with additional overlay features, in accordance with an aspect herein.

Turning next to FIG. 2, a top view of the engineered knit bra 32 includes material 34 having additional overlay (or integrally formed) features, in accordance with one aspect. With reference to the exemplary engineered bra front 24, the strap region 26 includes a strap pattern 36, the bust region 28 includes a bust pattern 38, a midline pattern 40, and a wing pattern 42, and the band region 30 includes a band pattern 44. In one aspect, the symmetrical orientation of the exemplary pattern features on the bra front 24 may correspond to a vertical, midline axis, and to the various regions of the bra such as the cup, strap, or band regions. In another aspect, the pattern features of the bra front 24 may be decorative elements integrally knit with the material 34, overlay treatments applied to the surface of the material 34, or engineered knit structures having both a visual impact and structural support for stabilizing the structure of the knit bra 32. In some aspects, For example, the strap region 26 includes a strap pattern 36 within the first zone 14, with the strap pattern 36 extending along an upper portion of the neckline of the engineered bra 32. In one aspect, the strap pattern 36 is an overlay treatment applied to the material 34, which may impact a modulus of elasticity associated with lockout zone A characteristics. As such, the strap pattern 36 may provide additional compression and/or prevent upward travel of a wearer's breast tissue, based on an amount of compression provided by at least a portion of the strap pattern 36 adjacent the second zone 16. For example, in some aspects, the strap pattern 36 extends beyond the strap length and towards the cups, along the x axis, to provide additional lockout support (e.g., adding downward force or compression to breast tissue and resist bounce), prior to transition into the stretch zone B characteristics of the second zone 16.

The material 34 may include knit pattern and/or surface overlay features that provide additional functional benefits within the unitary knit structure of the engineered knit bra 32, which may also correspond to particular engineered knit structures within a particular bra region. For example, with respect to the bust region 28, the bust pattern 38 may provide modesty and/or add compression to minimize upward bounce of a wearer's breast tissue, the midline pattern 40 may provide separation and/or support, and the wing pattern 42 may provide lift and/or stability within the bust region 28 and around a wearer's breasts. As such, the exemplary pattern features, which may be integrally knit and/or applied as an overlay, provide a function within the material that corresponds to particular pattern pieces of the bra, such as the bust region 28 having a bust pattern 38 positioned near a mid region of the cups and may be less dense than other pattern regions. In one example, an overlay feature may include a heat-bonded surface treatment applied to at least a portion of the bra material, such as a synthetic overlay that reduces stretch by restricting travel of stitches within the knit material. As such, an overlay may be applied, in an exemplary aspect, to a surface of the band region 30 to minimize stretch and/or stabilize the knit stitches, in addition to the minimized elongation or stabilizing already provided by knit structures, yarn type, and knit tension used within the band region 30.

During knitting of the material 34 in FIG. 2, and application of various pattern features to the corresponding strap, bust, and band regions 26, 28, and 30, the material 34 may be knitted in a direction of the y axis, along a working edge 46 and away from a lead edge 48. In one aspect, a change along the working edge 46 to a stitch type, yarn type, integrated structure/feature, or other engineered aspect of the material 34 may be applied in a horizontal manner along the x axis, with respect to the banded lockout zones A and C and stretch zone B. The resulting engineered bra front 24 may therefore include, in one aspect, horizontally oriented zones of lockout and stretch zones that transition seamlessly within the material 34 and can be modified according to a desired support level of a particular bra type.

Figure 3:
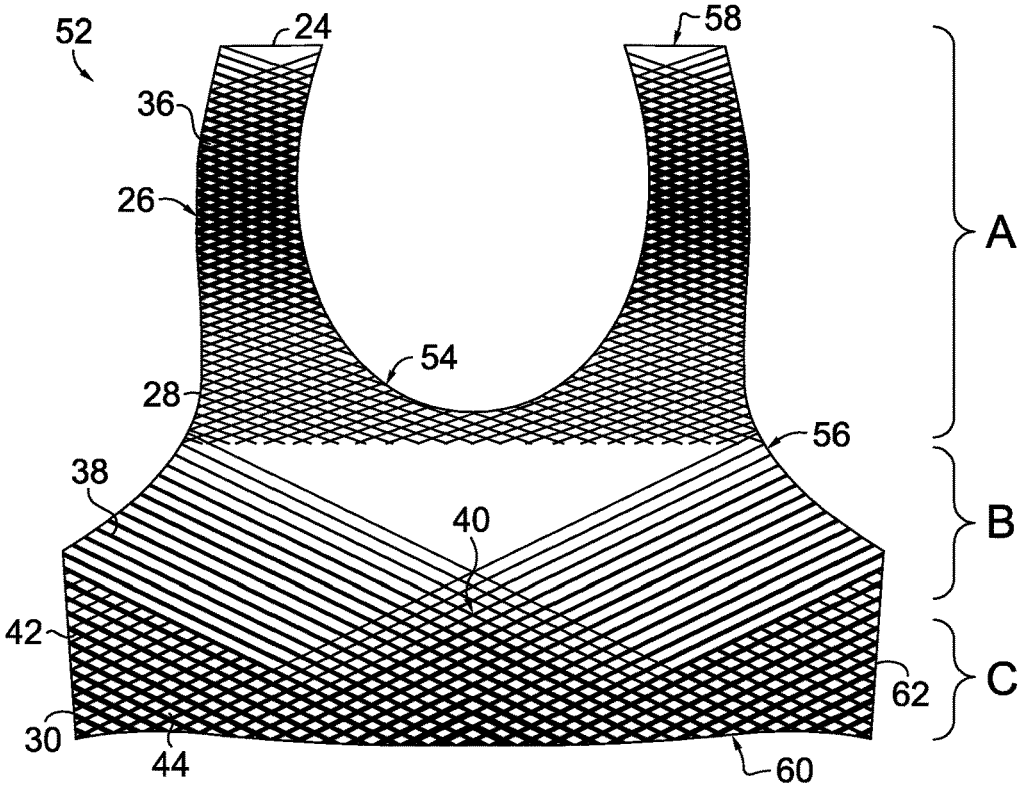
FIG. 3 illustrates a cut-out bra front of the engineered knit bra of FIG. 2, in accordance with an aspect herein.

For example, the bra front 24 may be extracted from the material 34 as shown in FIG. 3, with the cut-out bra 52 having a neckline edge 54, an underarm edge 56, a strap edge 58, a band edge 60, and a wing edge 62. Further, the cut-out bra 52 maintains the engineered lockout zones A and C and stretch zones B for assembly into an as-worn configuration, according to various aspects. Accordingly, the engineered bra front 24 may include lockout and stretch zones oriented in multiple directions, with seamless transition between zones of the bra providing varying support and stretch for ease of wear.

Figure 4:
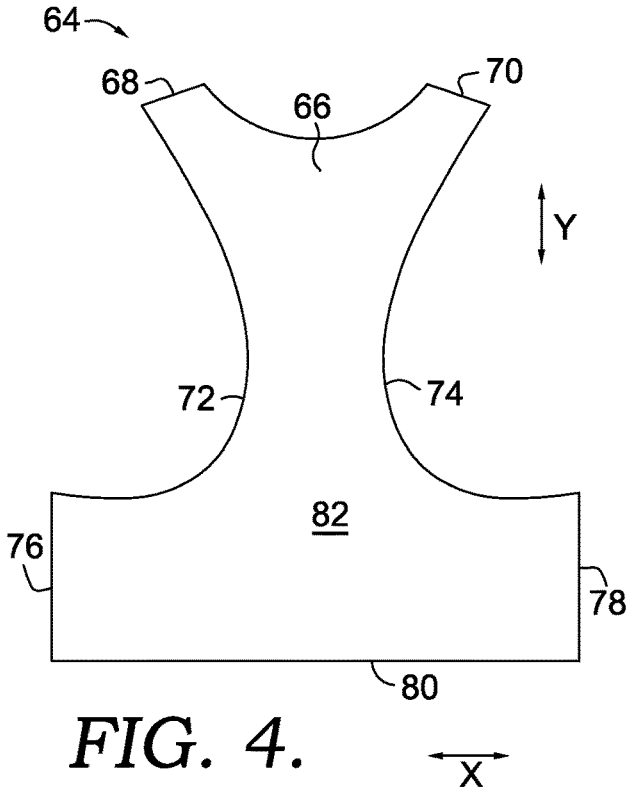
FIG. 4 illustrates an exemplary bra back configured to couple to the bra front of FIG. 3, in accordance with an aspect herein.

Accordingly, one example of a cut-out bra back 64 is depicted in FIG. 4, and includes a back material 66 having a left upper edge 68, a right upper edge 70, a left underarm edge 72, a right underarm edge 74, a left lower edge 76, a right lower edge 78, and a bottom edge 80. The back material 66 may include any material configured to couple to the bra front 24 at one or more adjoining features, such as the strap edges 58 mating to the left upper edge 68 and right upper edge 70, and the wing edges 62 mating to the left lower edge 76 and right lower edge 78. In one aspect, the surface 82 of the back material 66 includes a mesh structure, such as a vented mesh material having perforations that permit air transfer. In further aspects, the back material 66 may include any material characteristics configured to support one or more features of the corresponding bra front 24, such as an additional lockout zone C along the bottom edge of the bra back 64, or four-way stretch characteristics within a stretch zone B in a central portion of the bra back 64. Alternatively, an independent and/or complimentary stretch characteristic of the material 66 may provide a bra back 64 optimized for pullover ease and wear, regardless of the corresponding lockout and stretch zones opposite the bra front.

Figure 5:
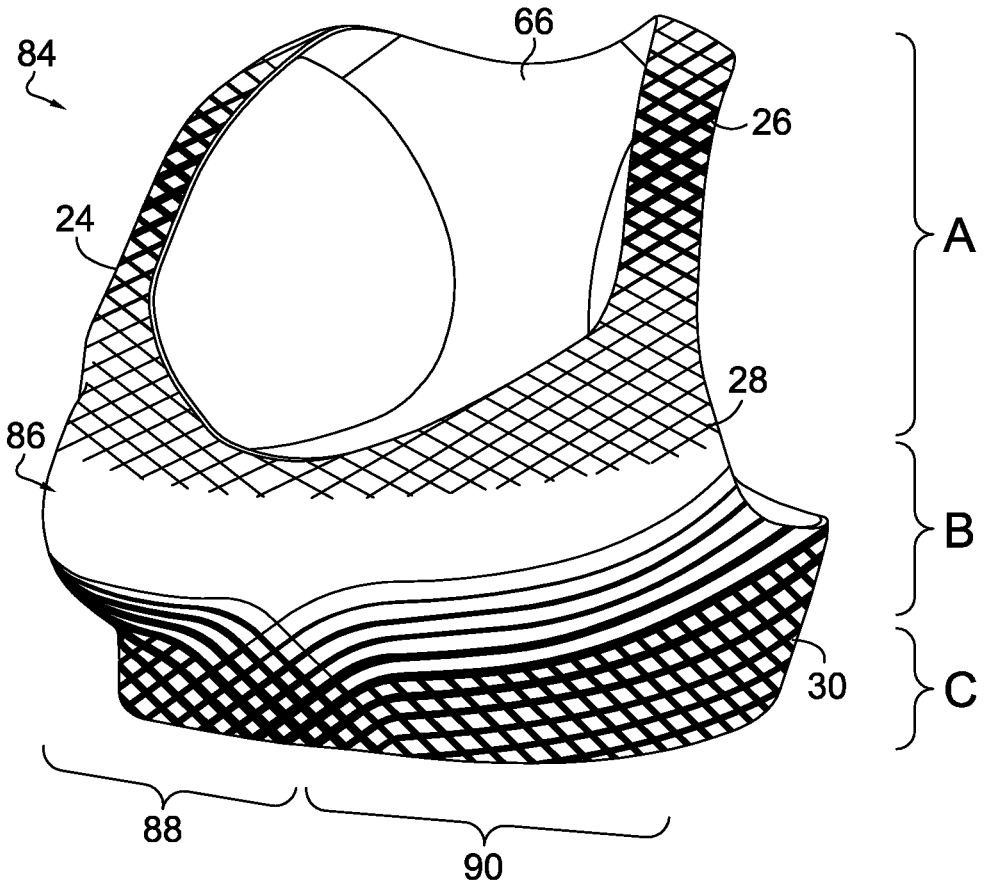
FIG. 5 illustrates an assembled, engineered knit bra with preconfigured lockout and stretch zones and additional overlay features, in accordance with aspects herein.

As positioned within the assembled, engineered knit bra 84 of FIG. 5, the various lockout zones A and C and stretch zones B may at least correspond to the preconfigured lockout and stretch zones of the bra front 24. Upon application of additional molding treatment to the assembled, engineered knit bra 84, a molded bust 86 corresponding to one or more characteristics within the stretch zone B may include a molded right cup 88 and a molded left cup 90. In one example, a variety of pattern and/or overlay features, such as those described with respect to FIGS. 2-3, may correspond to a particular engineered knit structure within a particular region for molding. As such, the molded bust 86 may include from FIG. 2 the bust pattern 38, midline pattern 40, and wing pattern 42 features that, once oriented with respect to the molded right cup 88 and molded left cup 90, provide a visual indication of the engineered knit zone within the bust region 28, and corresponding supportive elements integrated within the unitary structure.

Figure 6:
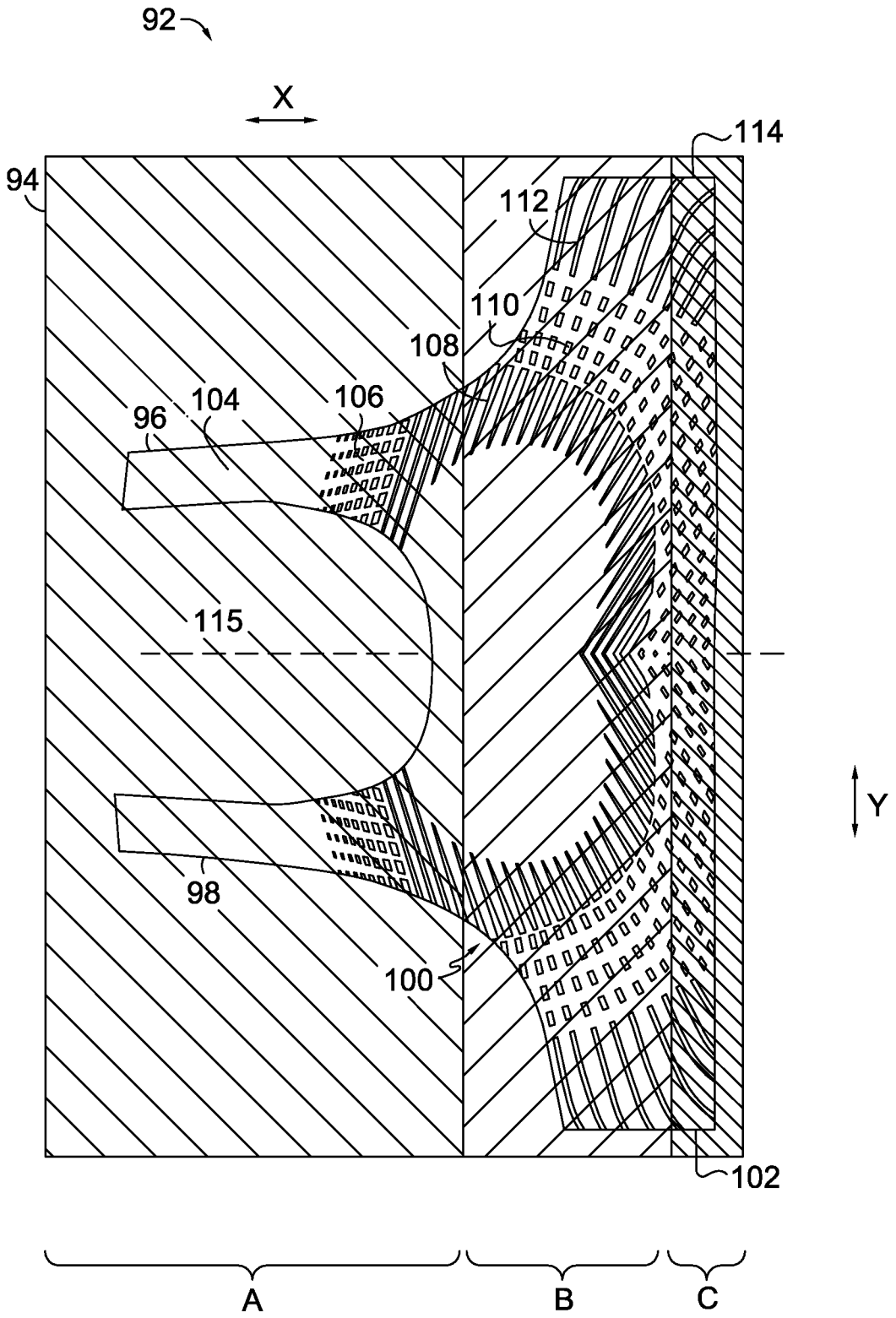
FIG. 6 illustrates a top view of an exemplary engineered knit bra material having preconfigured lockout and stretch zones, with additional integrated knit structures, in accordance with an aspect herein.

Turning next to FIG. 6, a top view of an exemplary engineered knit bra 92 includes a knitted material 94 having preconfigured lockout and stretch zones with additional integrated knit structures, in accordance with an aspect herein. The knitted material 94 includes knitted structure that provides lockout zones A and C adjacent a stretch zone B. In the example of FIG. 6, a bra front 96 may be oriented along a vertical axis y and a horizontal axis x of the knitted material 94 such that the strap region 98 includes knitted structure of the first lockout zone A. Further, the bust region 100 adjacent the strap region 98 may include knitted structure of the stretch zone B, while continuing a unitary knit structure between the regions of the bra front 96. For example, an engineered knit bra 92 may include stabilizing, locked out strap structures in a strap region 98 that are adjacent to and interconnected with stretching, moveable/shape-ready structures in a bust region 100. In one aspect, the strap region 98 and the bust region 100 may include at least one common characteristic between the two regions, such as a common yarn, common knit stitch, and/or common tension, while one or more characteristics vary between the regions to vary an amount of lockout. In other words, the two bra regions may be seamlessly joined and knitted in a unitary structure, with the functional characteristics of each region being determined by the stitch type, yarn type, yarn tension, and/or knit structure (i.e., the lockout and stretch characteristics) according to pattern placement within the knitted material 94, according to one aspect.

The exemplary knitted structure of the engineered knit bra 92 further includes a band region 102 adjacent the bust region 100 and corresponding to a second lockout zone C. As such, the unitary knit structure may continue between the bust region 100 and the band region 102, with the stretching, moveable/shape-ready structures in the bust region 100 adjacent to and interconnected with the stabilizing, locked-out band features in the band region 102. In further aspects, the bust region 100 and the band region 102 may include at least one common characteristic between the two regions, with a seamless joining between such regions and engineered functions of each region based on stitch type, yarn type, yarn tension, and/or knit structure (i.e., the lockout and stretch characteristics) and according to pattern placement within the knitted material 94.

While the lockout zones A and C and stretch zone B provide support, compression, structure, and/or shape to the bra, additional characteristics may be knitted into the engineered material 94 to enhance one or more functions of the bra front 96. In the example of FIG. 6, the bra front 96 may include a strap region 104, a first integrated structure 106, a second integrated structure 108, a third integrated structure 110, a fourth integrated structure 112, and/or a fifth integrated structure 114. Each of the exemplary integrated structures depicted here may be oriented along a particular portion of the bra front 96, with respect to at least a portion of the strap region 98, bust region 100, and band region 102. For example, the first integrated structure 106 may include a particular stitch type at an upper bust stitch region within the stretch zone B, such as a knit structure forming a transition between the lockout zone A of the strap region 98 and the boundary beginning at the stretch zone B. In further aspects, the stretch zone B may include a second integrated structure 108 having a particular stitch type encircling a cup region, a third integrated structure 110 at a bra body region, and a fourth integrated structure 112 having a particular stitch type at a wing region. The exemplary integrated structures within the stretch zone B may include multiple different stitch types, numbers, orientations, densities, or other engineered characteristics to provide a particular function within the bra front 96 knitted within the engineered knit material 94, such as additional support, structure, shaping, compression, or modesty characteristics. During knitting, such engineered characteristics may be generated using specific knitting machines providing various machine-knit construction techniques, such as a warp-knit construction, a circular knit construction, and a flat knit construction. As such, the orientation of the bra pattern within the knitted material may vary according to the knitting machine utilized and the various knit construction techniques available with each technology. Further, the lockout zone C of the band region 102 may also include one or more integrated structures, such as a fifth integrated structure 114, with a similar variety of functions within the bra structure, by virtue of various stitch types, numbers, orientations, densities, or other engineered characteristics within the material 94.

The integrated knit structures and/or patterns of the engineered knit bra 92 may be created, for instance, by changing one or more dimensions of individual or multiple knit stitches. For example, a stitch type, length, and/or spacing corresponding to a particular raised or depressed integrated knit structure may be included within the bra 92 and alter one or more characteristics of the knit material. In one aspect, a change in stitch length may provide varying stretch properties, such as a shorter stitch length providing a less stretch and a longer stitch length providing more stretch to the overall material. Such integrated knit structures may be used to modify the modulus of elasticity or compression force associated with various regions and/or zones of the bra 92. Further, the orientation and/or direction of such integrated knit structures, or the pattern of placement within the varying bra regions or zones, may further modify the direction of a compression force applied by the bra, a level of support maintained within the bra regions, and an alignment of support within particular bra regions and lockout/stretch zones.

Figure 7:
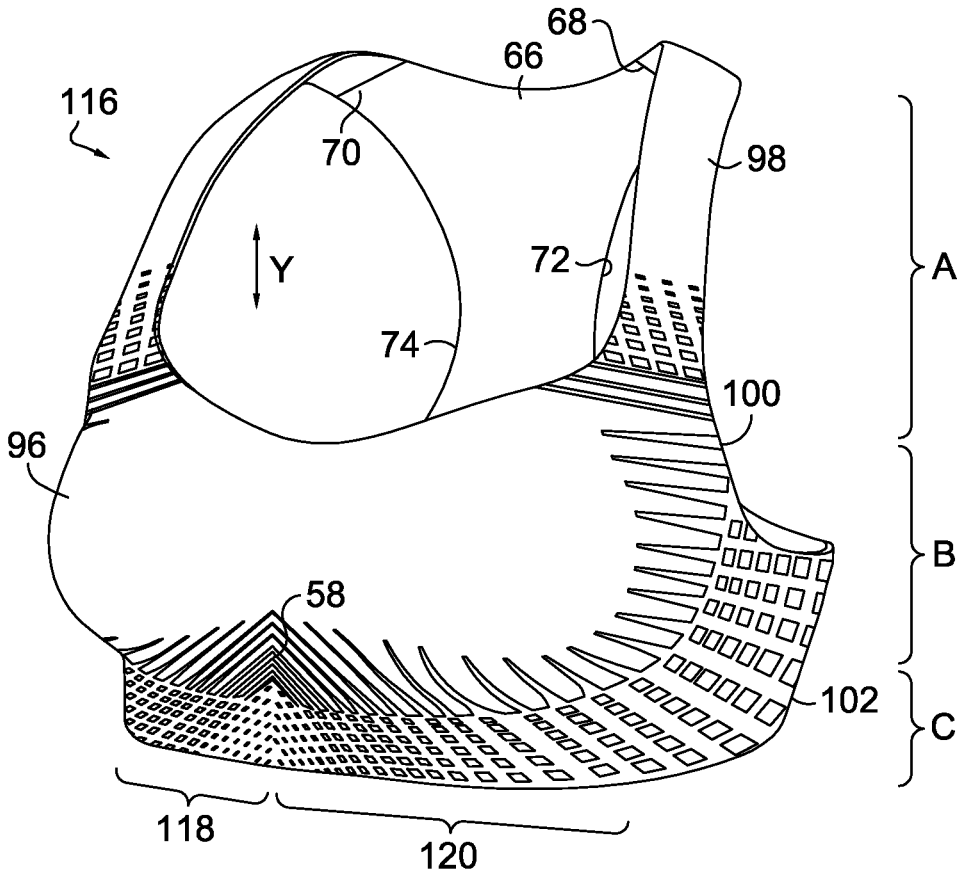
FIG. 7 illustrates a front, perspective view of an assembled, engineered knit bra with preconfigured lockout and stretch zones and additional integrated knit structures, in accordance with an aspect herein.
Figure 8:
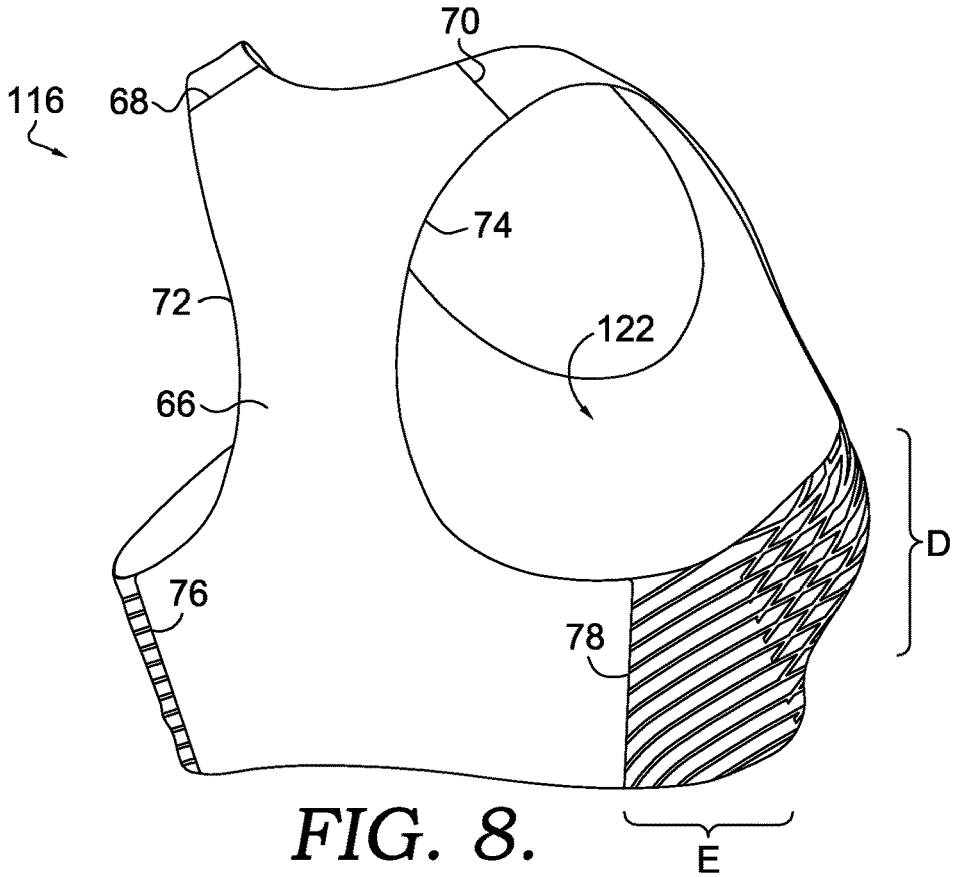
FIG. 8 illustrates a rear, perspective view of the assembled, engineered knit bra of FIG. 7, in accordance with an aspect herein.
Figure 9:
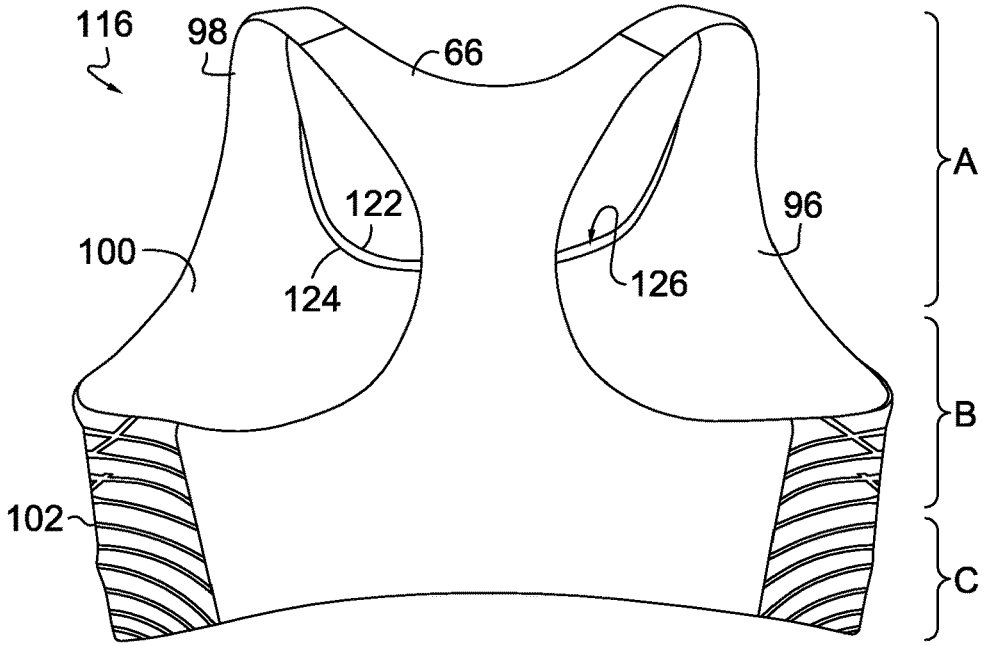
FIG. 9 illustrates a back view of the assembled, engineered knit bra of FIG. 7, in accordance with an aspect herein.

Once assembled, as shown in FIG. 7, the engineered knit bra 116 may include a bra back 64 coupled to the bra front 96 with preconfigured lockout zones A and C and stretch zones B, accented by additional integrated knit structures, according to one aspect. The bra front 96 may also include molded left and right cup features 120 and 118 within the bust region 100, oriented in the stretch zone B to receive heat treatment, compression, or other post-processing treatment. In some aspects, one or more integrated knit structures within the various zones of the engineered knit bra 116 may include jacquard structures that insert different yarns into different locations to form graphics within the lockout zones A and C and stretch zones B. In one aspect, the zonal position of jacquard structures, such as the left and right cup features 120 and 118 within the stretch zone B, may change the modulus of elasticity within the stretch zone B. For example, one or more jacquard structures within the stretch zone B may increase a modulus of elasticity within at least a portion of the stretch zone B, while in another example, one or more jacquard structures within the stretch zone B may decrease the modulus of elasticity within at least a portion of the stretch zone B. From the rear view of FIG. 8, the engineered knit bra 116 is shown having a bra front panel 122 that may include the same or different characteristics on the interior and exterior surfaces. For example, the bra front panel 122 may exhibit a different hand (e.g., a fabric feel corresponding to a particular coefficient of friction) on the interior surface than presented on the outer front region D and outer wing region E. In one aspect, the outer fabric feel, such as a raised integrated structure and/or particular orientation of engineered stitch structure, may vary within the front region D according to a particular location or function, while the bra front panel 122 includes an engineered knit feature providing a different (e.g., smoother) surface on the interior surface. In another aspect, as shown in FIG. 9, the assembled engineered knit bra 116 may include a bra front panel 122 opposite a bra interior panel 124, with at least one pocket 126 between each panel for providing modesty, support, enhanced material feel, and/or an internal cavity for inserting a bra cup liner.

Figure 10:
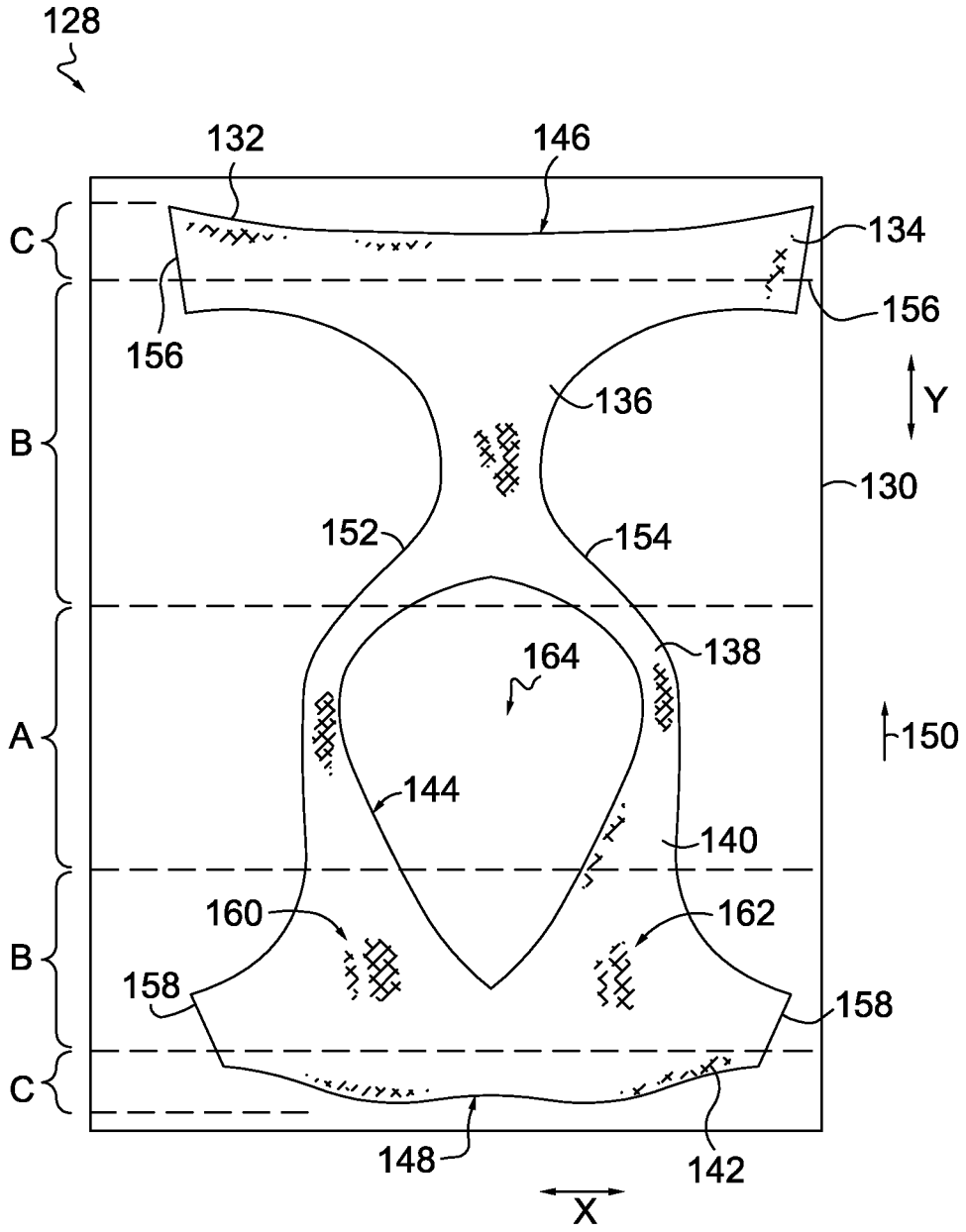
FIG. 10 is a top view of an exemplary engineered woven bra material having preconfigured lockout and stretch zones, in accordance with an aspect herein.

Turning now to the example of FIG. 10, a top view of an engineered woven bra 128 may be cut from a woven material 130 that includes multiple, preconfigured lockout and stretch zones that vary the stretch characteristics throughout the material 130, along both front and back regions of the bra body 132. For example, the bra body 132 may include a first zone 134 corresponding to a back band region having woven lockout zone C characteristic from woven structure and/or yarn type, which is adjacent a second zone 136 corresponding to a mid-back region having woven stretch zone B characteristic from woven structure and/or yarn type. The woven zone characteristics may be referred to as zones for convenience hereinafter.

Further, the second portion 136 may be adjacent a third portion 138 corresponding to a strap region also having woven lockout zone A characteristic, while a fourth portion 140 corresponding to a bust region having woven stretch zone B characteristic also adjoins the strap region of the third portion 138. The bra body 132 further includes a fifth portion 142 adjacent the fourth portion 140, with the fifth portion 142 corresponding to a front band region having third lockout zone C characteristic from woven structure and/or yarn type.

During weaving of the material 130, such as weaving along a working edge 148 opposite a lead edge 146 in a material assembly direction 150, each portion of the engineered woven bra 128 may be woven to include at least one lockout zone or stretch zone characteristic that is carried across multiple zones of the bra body 132. For example, at least one common warp yarn may continue from the lead edge 146 to the working edge 148, while each portion of the bra body 132 is engineered to provide a particular lockout zones A and C and stretch zone B characteristics. The woven material of the bra body 132, having outer bra edge 144 within the woven material 130, includes a seamless transition between adjacent stretch and lockout zones, with lockout and stretch characteristics (i.e., each zone's preconfigured woven structure and/or yarn type) dynamically adjusted to correspond to the strap region, bust region, band region, and cup region of the engineered woven bra 128.

Figure 11:
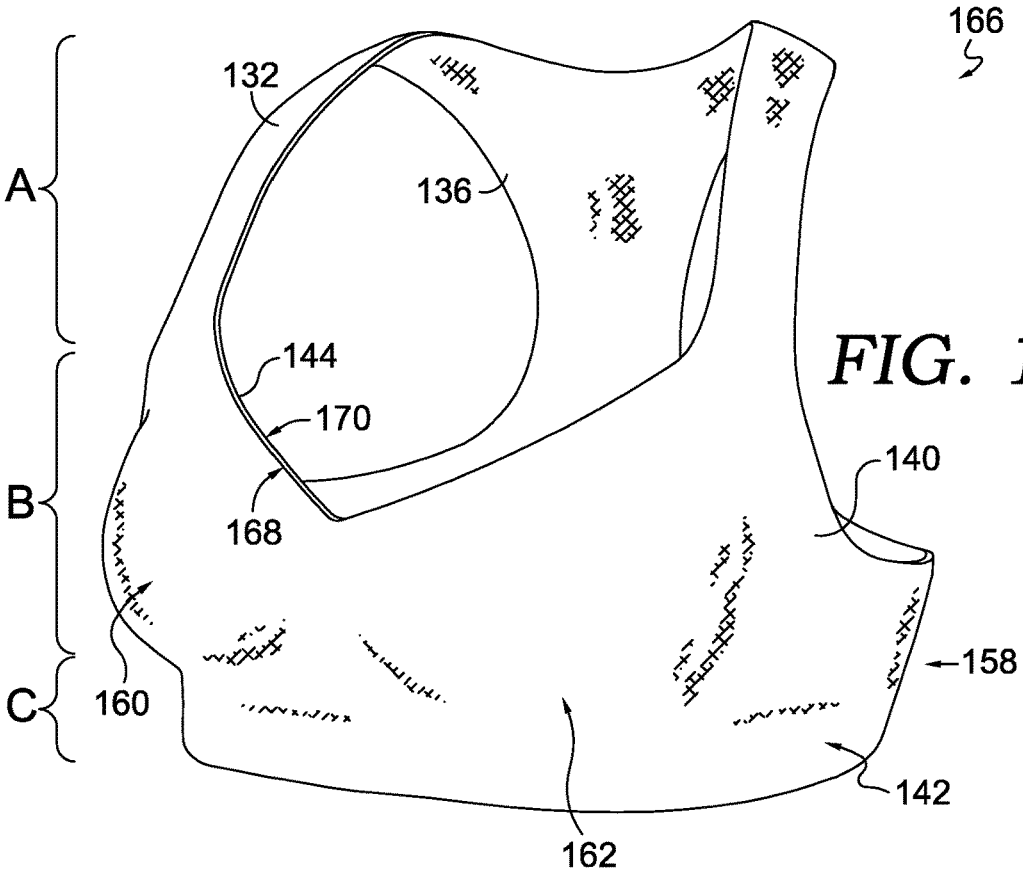
FIG. 11 illustrates a front, perspective view of an assembled, engineered woven bra with preconfigured lockout and stretch zones, in accordance with an aspect herein.

The exemplary bra body 132 may include a first strap 152, a second strap 154, a pair of back wing edges 156, a pair of front wing edges 158, a first cup region 160, a second cup region 162, and an aperture 164, as shown in the example of FIG. 10. The bra body 132 may be oriented such that the assembled, engineered woven bra 166 includes lockout zone A characteristics at a strap region proximate a wearer's shoulders, stretch zone B characteristics adjacent the strap region and around a wearer's bust, and lockout zone C characteristics at a band region beneath the wearer's bustline, as shown in FIG. 11. Similarly, in FIG. 12, the orientation of lockout zones A and C and stretch zones B, with respect to both front and back sides of the assembled, engineered woven bra 166, provides woven support and stability that restricts movement via lockout zones near strap and chest band regions of the bra body 132, while at the same time (and as part of the same woven material 130) providing woven stretch characteristics to permit shaping and/or structure via stretch zones near bust and mid-back regions of the bra body 132. The woven bra may therefore be engineered through one or more weaving techniques to include additional functional features, such as an integrated woven structure that provides lockout or stretch to a respective lockout or stretch zone. For example, additional integrated woven structures may provide a woven outer panel 168 opposite a woven internal panel 170 that includes an internal pocket 172 for positioning a cup liner or other feature inside the bra front. Further, the assembled, engineered woven bra 166 may be woven for assembly with minimal seaming, such as a single seam 174 between the back wing edges 156 and front wing edges 158, while still including additional woven layers or integrated woven structures, such as the integrated pocket 172, in one aspect.

Figure 12:
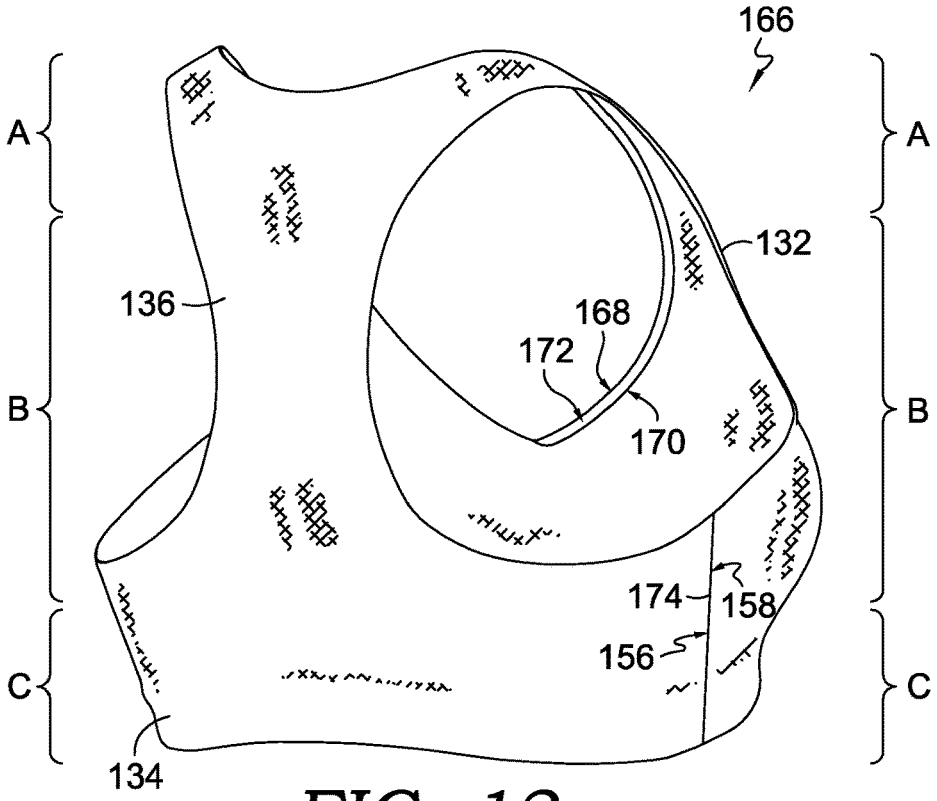
FIG. 12 is a rear, perspective view of the assembled, engineered woven bra of FIG. 11, in accordance with an aspect herein.
Figure 13:
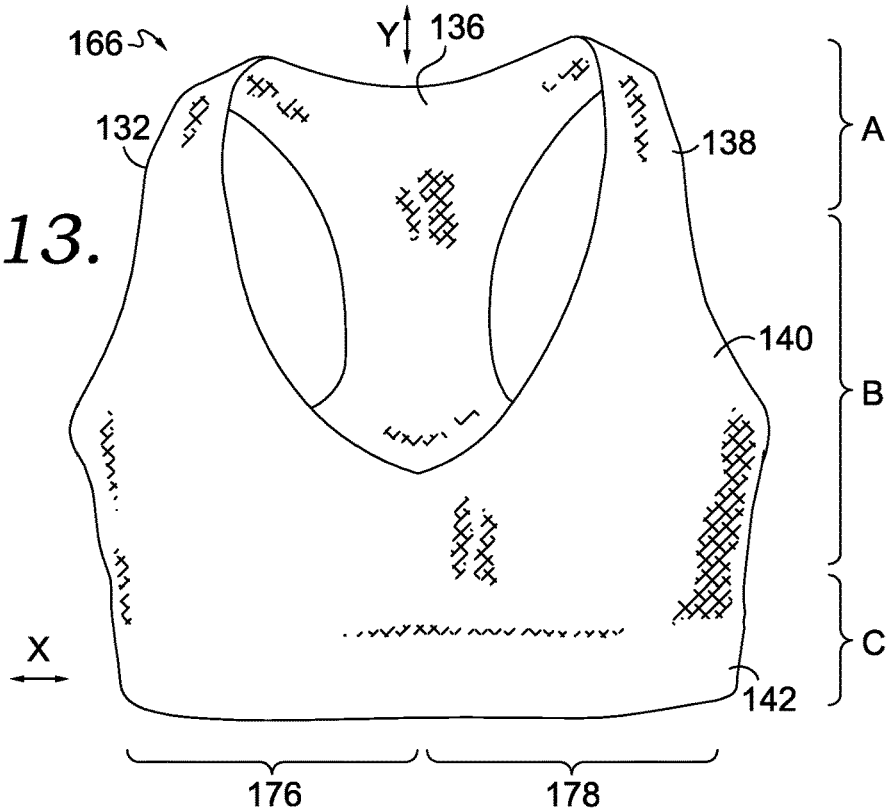
FIG. 13 is a front view of the assembled, engineered woven bra of FIG. 11, in accordance with an aspect herein.

Although depicted in FIGS. 10-12 as having lockout zone C proximate a chest band region of the assembled, engineered woven bra 166, at least a portion of the front or back band regions of the bra may include zonal lockout characteristics associated with one or more integrated woven structures. For example, along a midline portion of the lockout zone C, at least a portion of the bra body 132 may include integrated lockout structures that change an amount of lockout along the consistent weft yarns within lockout zone C. In another aspect, stretch zone B characteristics having warp and weft yarns woven throughout, may also include zonal stretch properties corresponding to one or more integrated woven structures. As such, within each lockout or stretch zone, in some aspects, a variably level of lockout or stretch may be zonally positioned based on In further aspects of the woven bra body 132, additional post-processing treatment of particular portions of the woven material 130 may further configure different features of the assembled bra 166 without joining additional pieces (e.g., seaming or adhering additional structures or pattern pieces to the existing bra body 132). For example, the first cup region 176 and second cup region 178 of FIG. 13 may be molded to provide structured support within the stretch zone B, and without the added rigidity of the woven characteristics in adjacent lockout zones A and C. The structured support within the bust region of the fourth portion 140 may further include one or more additional or alternative weft yarns inserted within the material 130, creating a change in engineered, woven structure along the x axis. Accordingly, in one aspect, a series of lockout zones having particular woven structure (e.g., "engineered" via yarn type, weaving technique, etc.) may vary with respect to alternating, adjacent stretch zones having particular woven structure (e.g., "engineered" via a different yarn type and/or weaving technique). In one aspect, a woven lockout zone may be engineered having a particular yarn density, weave structure, and/or changes between yarn content, such as a hard yarn or stretch yarn.

Figure 14:
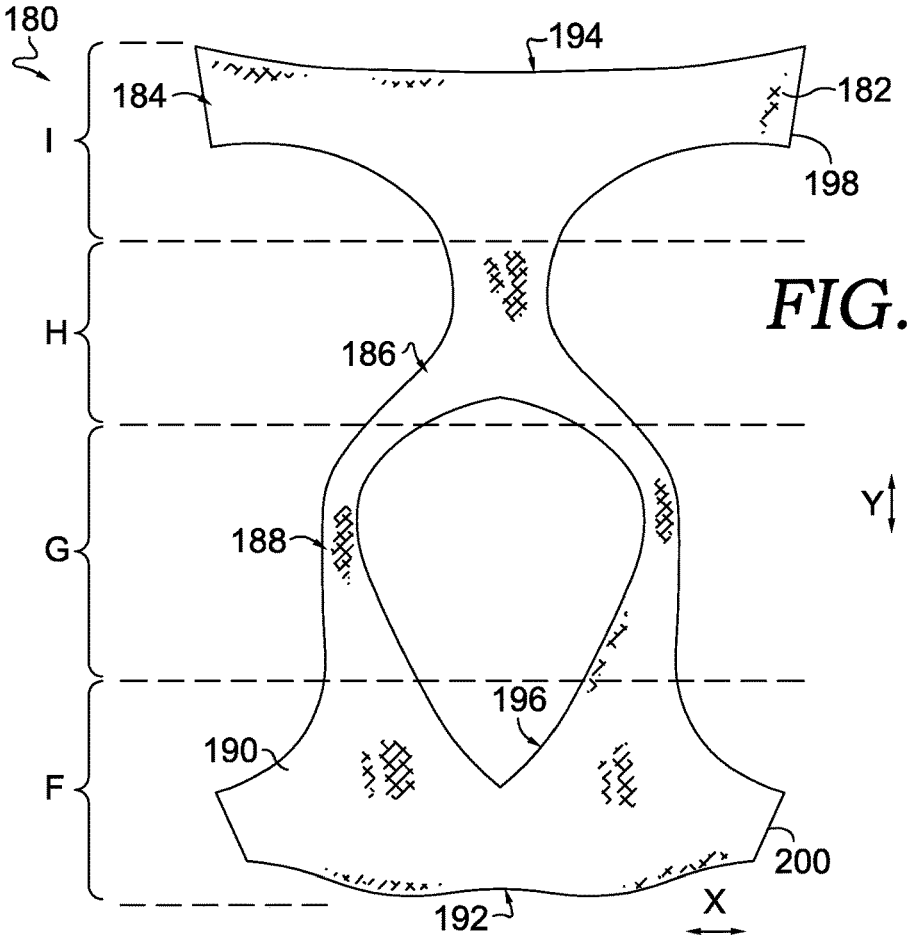
FIG. 14 is a top view of an exemplary engineered woven bra material having preconfigured lockout and stretch zones, in accordance with an aspect herein.

With reference to FIG. 14, one such example of varying zones is depicted in the woven bra 180, with preconfigured lockout and stretch zones oriented along the bra body 182. In this example, the bra body 182 includes a first bra region 184, a second bra region 186, a third bra region 188, and a fourth bra region 190, with a front edge 192 opposite a back edge 194, a neckline edge 196, a pair of back wing edges 198, and a pair of front wing edges 200. In this example, the first bra region 184 and third bra region 188 may include the same or similar stretch characteristics, such as a reduced amount of engineered stretch (i.e., locked-out material preventing stretch), while the second bra region 186 and fourth bra region 190 may include the same or similar enhanced stretch features. Alternatively, each functional aspect of the bra may include a different degree of engineered properties, such as a front zone F having moldable, four-way stretch with heat-sensitive weft yarns integrated with core modesty weft yarns, which may be adjacent a strap zone G having full lockout provided by weaving technique and/or hard yarn insertion, for example. Additionally, the upper back zone H, adjacent strap zone G, may include a lighter woven yarn with enhanced breathability and modest stretch, while the adjacent lower back zone I may be engineered to provide at least partial lockout via yarn insertion and/or weaving characteristics.

Figure 15:
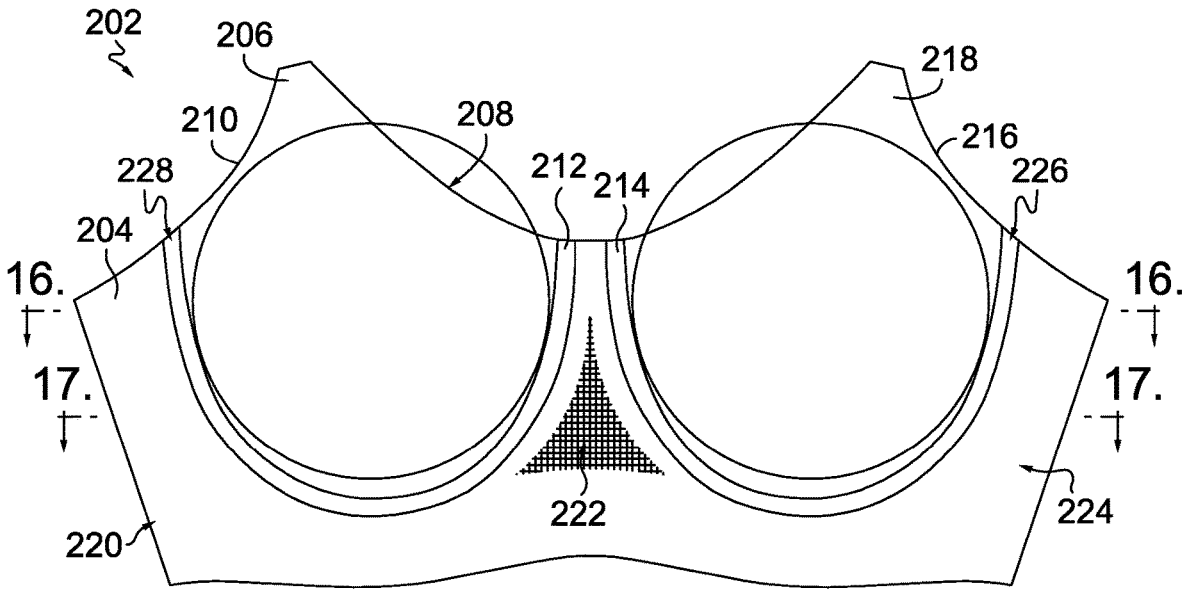
FIG. 15 is a front view of an exemplary engineered woven bra having preconfigured lockout and stretch zones, support channels, and cup pockets integrated within the woven material, in accordance with an aspect herein.

Turning next to FIG. 15, a front view of an exemplary engineered woven bra 202, having preconfigured lockout and stretch zones, support channels, and cup pockets integrated within the woven material, is provided according to one aspect. The bra body 204 includes a first strap region 206 adjacent a first cup 210 with an internal pocket 208, and a first channel 212 along a lower portion of the cup 210 that includes an inner cavity 228 for receiving an underwire, cable, and/or other support structure. The bra body 204 further includes a second strap region 218 adjacent a second cup 216 with an internal pocket 208, and a second channel 214 along a lower portion of the cup 216 that includes an inner cavity 226 for receiving an underwire, cable, and/or other support structure. The bra body 204 surrounding the first cup 210 and second cup 216 may include a band region 220, a middle region 222, and a wing region 224, with one or more engineered woven features, including one or more areas having lockout zone and/or stretch zone characteristics. For example, at least a portion of the wing region 224, middle region 222, and/or band region 220 may include a woven lockout zone characteristic (i.e., reduced stretch, hard yarns, etc.), while the first cup 210 and the second cup 216 may include woven stretch zone characteristics at preconfigured locations.

Figure 16:
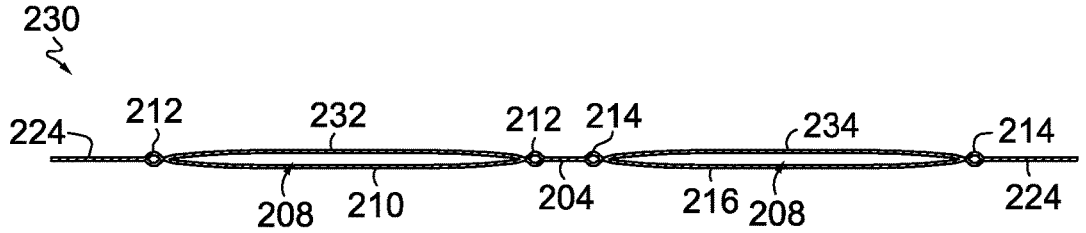
FIG. 16 is a cross-sectional view of the engineered woven bra of FIG. 15 at a first location, including support channel and cup pocket features, in accordance with an aspect herein.
Figure 17A:
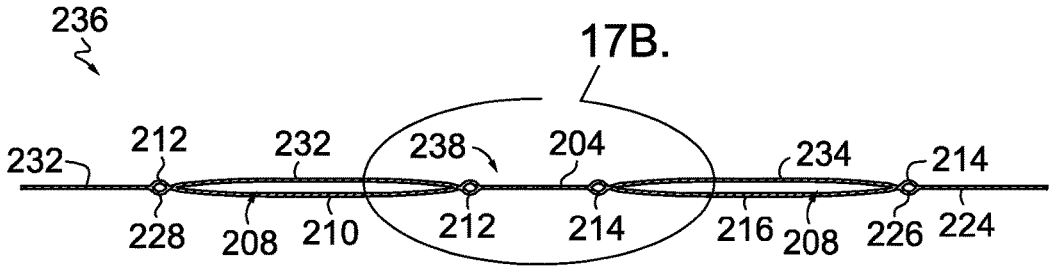
FIG. 17A is a cross-sectional view of the engineered woven bra of FIG. 15 at a second location, including support channel, cup pocket, and venting features, in accordance with an aspect herein.
Figure 17B:
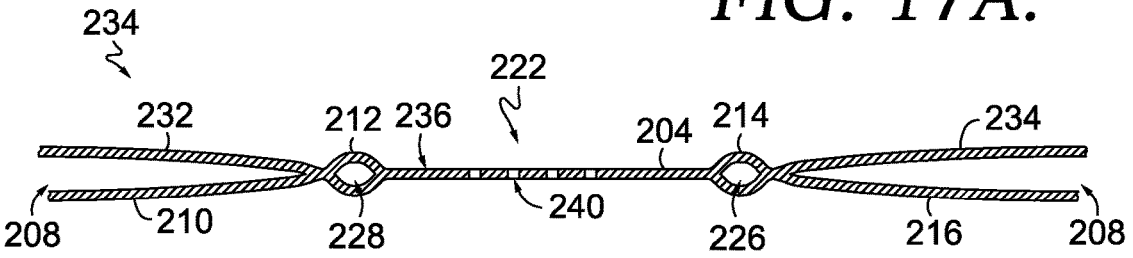
FIG. 17B is an enlarged, cross-sectional view of the engineered woven bra of FIG. 17A depicting the venting features in accordance with an aspect herein.

As further depicted in the cross-sectional view 230 of FIG. 16, the engineered woven bra 202 may include single layers or multiple layers of woven material that provide openings within the engineered bra body 204, such as the internal pockets 208 created between pocket layer 232 and first cup 210, and between pocket layer 234 and second cup 216. The bra body 204 outside the first and second cups 210 and 216, and between the inner edges of the first and second channels 212 and 214, may be characterized as having a single layer, according to one aspect. With respect to the view in FIG. 16, in one aspect, the middle portion of the bra body 204 between the first and second channels 212 and 214 includes a unitary woven structure similar to the external wing regions 224. However, as shown in the cross-sectional view 236 of FIGS. 17A-B, the middle region 222 may include additional woven structure 238 integrated with the surrounding bra body 204, such as a series of perforations 240 that provide venting within the woven bra body 204. In this example, as shown in FIG. 17B, the perforations 238 may be any woven or integrated structure within the bra body 204 that is configured to provide, at a preconfigured location, a particular function within the middle region 222. As such, a change in weaving technique, yarn type, inserted zonal yarn placement, etc., may be used to generate additional functional features within the engineered woven bra 202, without requiring further assembly or attachment to the bra body 204.

As shown in the example of FIG. 15, the integrated weaving of engineered bra structures providing cup pockets, channeled cavities, vented structures, and/or banded support may be achieved through various aspects of the engineered woven bra 202, engineering the desired features of various zones within the bra body 204, rather than inserting, seaming, sewing, and/or bonding functional aspects of a woven bra having both stretch and lockout zones. Further, the engineered woven characteristics of the bra body 204 may correspond to various yarn densities, woven structures, hard yarn placement, stretch yarn placement, or a combination of such aspects to generate an optimal degree of lockout or stretch for various regions of the bra.

Figure 18:
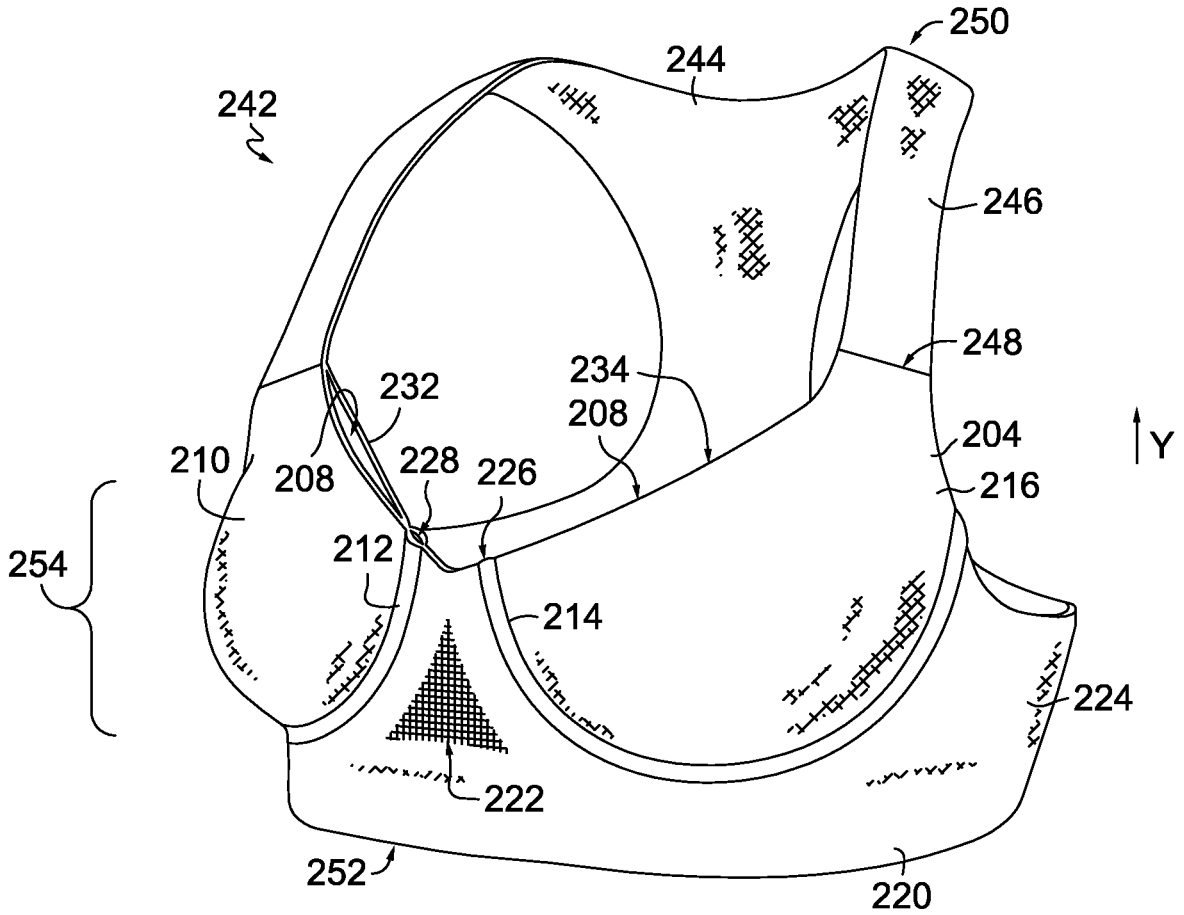
FIG. 18 is a front, perspective view of an assembled engineered woven bra having the bra-front structure of FIG. 15, in accordance with an aspect herein.

With reference finally to FIG. 18, a front, perspective view of an assembled engineered woven bra 242 includes the bra-front structure of the engineered woven bra 202 in FIG. 15, coupled to a bra back 244 having straps 246 that join the first strap region 206 and the second strap region 218 at the respective strap seams 248, according to one aspect. In an as-worn configuration, the upper end 250 of the bra 242 is positioned opposite the lower end 252. The front of the woven bra 240 may include molded cup features 254 that further provide structure to the first cup 210 and second cup 216. The perspective view of FIG. 18 further depicts the internal pockets 208 formed between the pocket layer 232 and first cup 210, and between the pocket layer 234 and second cup 216. The internal pockets 208 of the molded cup features 254 may be used to receive additional lining, shaping, lifting, or modesty-enhancing features, without having to sew on a pocket structure or cut into the woven material of the bra body 204, in one aspect, based on weaving an open edge along the top of both the first and second cups 210 and 216.

In another example, a variety of channeled structures, pockets/cavities, venting features, support structures, lockout zones, stretch zones, single-layer features, double-layer features, compression features, mold characteristics, yarn insertion techniques, integrated structures, or other various available weaving techniques may be utilized as part of the engineered woven bra. Additionally, at least a portion of such characteristics described with respect to the engineered woven bra may further be utilized within one or more aspects of the engineered knit bra, and vice versa. For example, where a bra material transitions between a single and double layer across the same row of material, it is contemplated that both engineered knit and engineered woven embodiments may utilize such techniques. Similarly, while producing a pocket structure, a channeled structure, a vented structure, and the like, aspects herein include incorporating each of said structures into an engineered knit or an engineered woven bra garment.

In further aspects of the engineered knit or engineered woven bra, the modulus of elasticity of the plurality of support zones may vary according to a preconfigured placement of a specific lockout zone or stretch zone. For example, a first modulus of elasticity may be assigned to a first support zone in a preconfigured first location along a bottom edge of a material. Additionally, a second modulus of elasticity may be assigned to a second support zone in a preconfigured, second location adjacent the first support zone. In some aspects, a bra structure may include a particular modulus of elasticity corresponding to a particular support zone, such as a modulus of elasticity within a predefined range for a lockout zone, and a modulus of elasticity within a predefined range for a stretch zone. To further modify such elasticity characteristics, the knitted or woven aspects within a zone may include engineered features to modify a particular portion of the support zone, such as a bust portion including a bust support engineered feature, and a wing portion including a wing support engineered feature. In some aspects, a lockout zone of an engineered knit or engineered woven bra may include a maximum of 20% stretch from an original position, while adjacent stretch zones may be configured to permit stretch greater than 20% with respect to at least a portion of the stretch zone. As discussed above, the varying modulus of elasticity of each zone within the bra may be determined by one or multiple engineered factors, such as the yarn selection to identify a particular size of stretch yarn to achieve a desired change in modulus.

Accordingly, in some aspects, yarn type (either knit in or laid in), knit structure, and knit tension may be adjusted to achieve a desired level of lockout or stretch in a zone of an engineered knit bra. Similarly, yarn type (in warp and/or weft direction), yarn density and weave structure may be adjusted to achieve a desired level of lockout or stretch in a zone of an engineered woven bra.

Throughout the various support zones of the bra front, either in an engineered knit or an engineered woven aspect, a common characteristic may be integrated throughout the structure of the woven or knitted material, as described in aspects above with respect to the unitary and/or seamless aspects of the engineered knit or woven construction. For example, a common yarn, such as a common warp yarn or a common weft yarn, may extend across multiple zones in an engineered bra. Additionally, based on the common characteristic extending across multiple zones, a common integrated feature may be carried throughout the knitted or woven bra. For example, a common yarn may include a single weft yarn of a particular material that is used within multiple zones of the bra, while at the same time being utilized for different integrated weaving or knitted structures in each zone. In another example, the common characteristic may be a consistent warp yarn, where the varying engineered features between zones include a first weft yarn with a first elasticity in a first support zone, and a second weft yarn having a second elasticity in a second support zone, providing an integrated warp-yarn feature across multiple zones without requiring joining or seaming.

Further aspects of the engineered support zones, such as the lockout zones and stretch zones described with reference to the exemplary engineered knit and engineered woven bras above, include incorporating an engineered feature in a first support zone that is different than an engineered feature of a second zone. For example, a first woven zone may include a first integrated feature, such as a lockout band region, while a second woven zone may include a second integrated feature, such as a double-layer woven cup region. In another example, a first knitted zone may include a particular lockout stitch pattern, while a second knitted zone may include a particular stretch-knit stitch pattern, thereby varying the engineered features of each zone. In further aspects, each lockout zone of the engineered knit or woven bra may be joined to each adjacent stretch zone, and may share similar integrated structures and/or engineered features for modifying a modulus of elasticity to a particular range, orienting bra components (i.e., cup region, strap region, band region, wing region, and/or back region) for optimal assembly, and unifying the bra garment such that the woven or knitted material includes engineered features that minimize any finishing and/or seaming processes.

In some aspects, the orientation of lockout and stretch zones may be vertical or horizontal, depending on the construction of the knitted or woven material and layout of the bra pattern features. For example, although shown in an upright position with the width of the bra oriented along the width (x axis) of the knitted or woven material, the bra may also be oriented along the length (y axis) of the knitted or woven material in some aspects. Accordingly, various aspects of the engineered knit and engineered woven materials described here may include horizontal or vertical lockout zones. Similarly, a pattern position of the bra front within the knitted or woven material may further determine an orientation of the lockout and stretch zones within the bra and with respect to particular bra structures, such as the cup region and strap region. Further, the engineered structure of the knitted or woven material described herein may include additional stabilizing treatments that are later added to the fabric, according to some aspects. As such, a pattern placement and pattern treatment may further impact orientation and strength of lockout and stretch zones of the engineered bra.

Additionally, as discussed below with respect to FIGS. 19-23, aspects of an engineered bra include generating an engineered knit material with integral bra functions throughout the material. For example, an engineered knit material may be configured with integral bra functions that are created within the engineered knit material during the process of knitting a unitary bra front. As such, various bra functions integral to the engineered knit material may correspond to the zonal placement of one or more yarns and/or the zonal stitch construction within the engineered knit material, with resulting zonal features corresponding to specific portions of a bra front. Each zone may include one or more stretch characteristics that vary between adjacent zones of the material. Such zonal features may include a modulus of elasticity in one or more directions that varies between neighboring zones within the engineered bra. Accordingly, without piecing together multiple different knitted pattern pieces that individually exhibit a particular bra function, the integral, zonal orientation of yarns and stitch construction across the width of the engineered knit material (and length of the resulting engineered bra front) may seamlessly provide variable support and optimal construction with minimal seaming along a length of the bra body (i.e., the width of the bra material).

Upon extracting one or more engineered knit bra fronts from the engineered knit material, the engineered knit bra maintains the zonal features of the engineered knit material, as oriented within the bra front, such as a warp-knitted, engineered knit bra front, providing targeted support to a user when worn. As an example, a particular yarn arrangement and knit construction within a first band of warp-knit stitches may be adjacent a second band of stitches having a particular yarn arrangement and knit construction. While the same or similar yarns may be included in both the first and second bands, one or more aspects of the warp-knit construction may change between the two bands. Alternatively, while the same or similar knit construction between the first and second bands may remain constant, one or more yarns knitted within the adjacent bands may be different.

As used below with reference to FIGS. 19-23, a particular yarn, yarn selection, yarn placement, and/or yarn arrangement may be used to refer to the knitted position of yarns within the engineered knit bra, and as such, within the engineered knit material from which the engineered knit bra is extracted. An engineered knit yarn may have a particular denier differential that is targeted (i.e., selected) for a particular function within a support zone of the engineered bra. Accordingly, a yarn having a first denier differential may be selected for knitting within the strap zone while a yarn having a second denier differential may be selected for knitting within the cup zone. Still further, a change in denier differential between one or more yarns in the engineered bra may also change between the yarns in the cup zone and the yarns in the chestband zone. In some aspects, yarn placement within the engineered bra may also refer to a knitted position of a particular yarn with respect to a fabric face and a fabric back. For example, a planar engineered knit material may include a first side and a second side opposite the first side, such as a fabric face and a fabric back. The fabric face of an engineered knit material, and the fabric face of the corresponding engineered knit bra may refer to an outward-facing yarn arrangement that is exposed when the engineered bra is in an as-worn configuration. Further, the fabric back of an engineered knit material, and the engineered knit bra, may refer to an inward-facing yarn arrangement that contacts a wearer's upper body when the engineered knit bra is in an as-worn configuration. In some instances, the various characteristics of the fabric face and/or fabric back of the engineered knit material may be referred to as the material "hand," having both skin-contacting surfaces (the fabric back) and non-contacting surfaces (the fabric front).

To provide a transition between adjacent zones within the engineered knit bra, at least one stitch of each of the adjacent zones may be knitted together, such as in a banded configuration of a warp-knit construction. In some aspects, a seamless transition is provided between adjacent zones of the engineered knit bra based on one or more knit stitches interlocked with one or more neighboring knit stitches of the adjacent bra zones. For example, at least one stitch of a first engineered knit zone may be knitted with at least one stitch of a second engineered knit zone adjacent the first zone. Additionally, in other aspects, one or more yarns of a first zone may be knitted across two or more adjacent zones, such as a first yarn knitted across both a first zone and an adjacent second zone. Further, while a portion of the engineered knit material may provide a first bra function in a first zone corresponding to a first yarn and a first stitch construction, another portion of the same engineered knit material may provide a second bra function in a second zone, such as a second yarn and a second stitch construction.

The engineered knit material, and extracted engineered knit bra, may include a fabric face and fabric back, with distinct characteristics of both the fabric face and the fabric back corresponding to specific yarn selection, number and/or orientation of warp-knit bars, fiber content of one or more yarns, and/or arrangement of the yarn type within the knitted material. Accordingly, while a first side of the engineered knit bra may have a specific feel generated via yarn selection and/or stitch construction, a second side of the engineered knit bra may have a specific feel generated via yarn selection and/or stitch configuration such that an inner surface of the bra may differ in construction and content from an outer surface of the bra. In some instances, the fabric back may be a skin-contact surface when the engineered bra is in an as-worn configuration, while the fabric front is configured as an outward-facing surface having different yarns and/or different construction than the fabric back.

Figure 19:
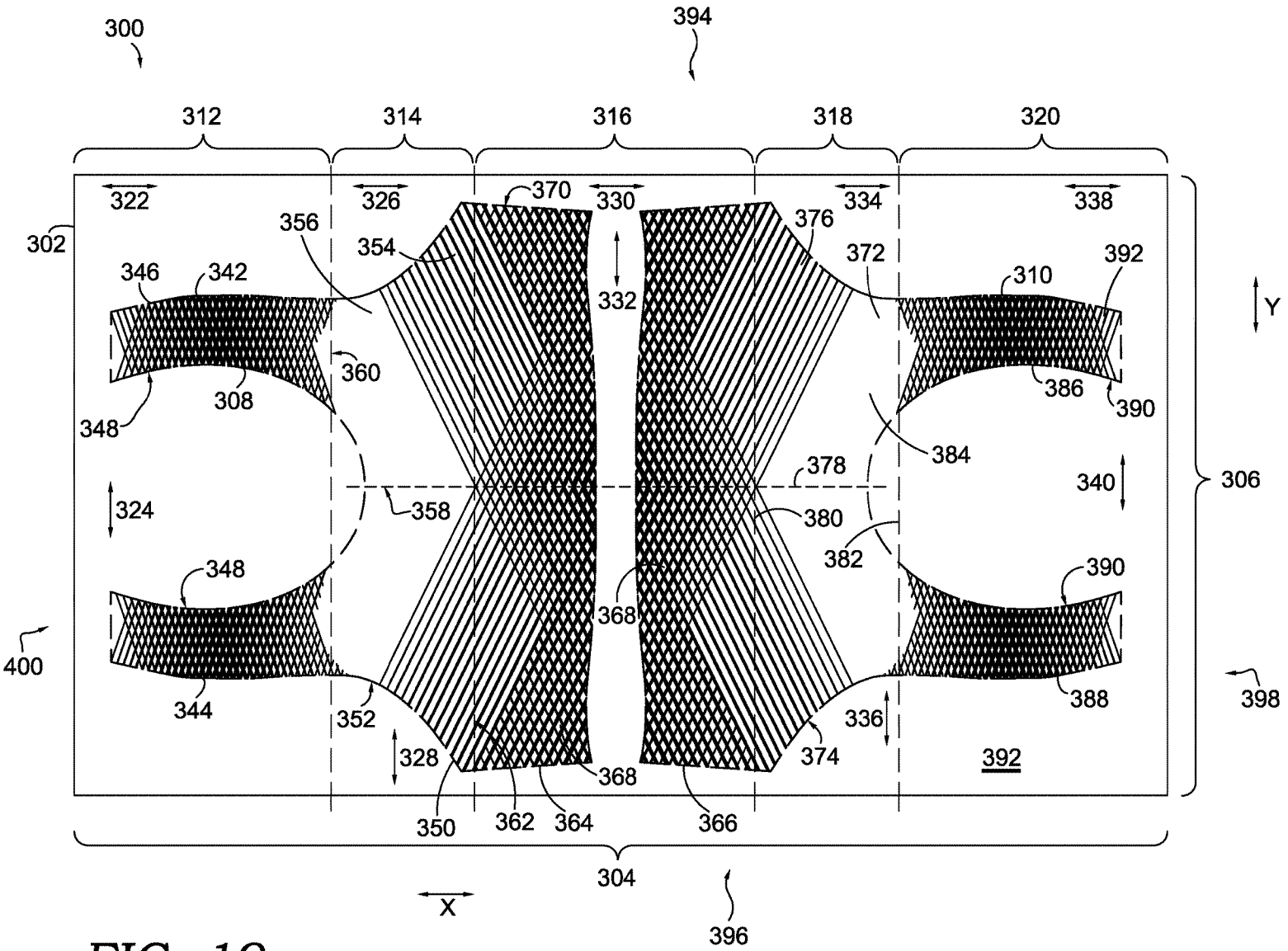
FIG. 19 is illustrates a top view of an exemplary engineered knit bra material having preconfigured lockout and stretch zones, in accordance with an aspect herein.

In one example, as shown in FIG. 19, an engineered material 300 may include a fabric 302 having a fabric width 304 oriented along a horizontal x axis and a fabric length 306 oriented along a vertical y axis. The exemplary engineered material 300 is shown having a first engineered bra front 308 and a second engineered bra front 310 identified as pattern pieces for extraction from the fabric 302. As such, the bra width of both the first engineered bra front 308 and the second engineered bra front 310 is oriented along the y axis of the fabric length 306 and the bra length of each engineered bra front is oriented along the x axis of the fabric width 304. In some aspects, the engineered bra fronts 308 and 310 are oriented along the fabric width 304 such that each support zone within the engineered bra corresponds to a horizontal band within the bra front (i.e., within a vertical band along the fabric length 306.

With continued reference to FIG. 19, aspects of the engineered knit bra front 308, 310 include zonal construction of the warp-knitted, engineered fabric 302 from which the engineered knit bras 308 and 310 are extracted. Accordingly, along the fabric width 304 of the fabric 302, a first zone 312, a second zone 314, a third zone 316, a fourth zone 318, and a fifth zone 320 correspond to banded regions of warp-knitting that are generated using variable yarn selection and/or stitch configuration. The knitted construction of each of the zones within the warp-knitted fabric 302 include a variety of yarns and warp-knit stitches selected for a particular bra support function, such as a bra strap zone, a bra cup zone, and a bra chestband zone. In further aspects, additional and/or alternative functional zones within a bra may be engineered within the knitted construction of the engineered material 300 and according to additional and/or alternative zones within the fabric 302. Although depicted in the example of FIG. 19 as having six preconfigured zones (first zone 312, second zone 314, third zone 316, fourth zone 318, and fifth zone 320), in additional aspects, the engineered material 300 may generate a fabric 302 having a fewer or a greater number of zones providing engineered functions to a bra. The fabric 302 may also be configured to include a single bra front 308 along the fabric width 304 based on an overall width of the fabric 302. Alternatively, the fabric 302 may include enough material to facilitate the construction of more than two bra fronts across a fabric width 304, with each bra front having lockout and stretch zones corresponding to the features of various engineered zones across the fabric width 304, and along banded columns of the fabric length 306.

Engineered lockout within the first zone 312 may be provided based on a fiber content of the yarn, and a degree of lapping within the respective courses and wales of the first zone 312. In one aspect, the number of bars used in warp knitting within the first zone 312, combined with a lapping configuration within the first zone 312, as well as the fiber content of the yarns on three bars used within the first zone 312, may be used to generate the optimal elongation and lockout characteristics for the particular bra function within the first zone 312.

Further, in the example of FIG. 19, each zone may be engineered for a particular bra support function within the engineered lockout and stretch zones and along a specific axis/direction within the engineered material 300. Such yarn selection may include at least one bar of warp-knitting yarn having fiber content within a threshold range from a 50 denier/72 filaments (50/72) polyester, and at least one bar of warp-knitting yarn having fiber content within a threshold range from a 30 denier/36 filament polyester. In some aspects, a warp-knitted bar having a 50/72 polyester yarn may be oriented to knit a fabric front surface, while a warp-knitted bar having the 30/36 polyester may be configured to knit a fabric back surface. Such differential between a fabric front and fabric back may provide a denier differential that enables the engineered material 300 to transfer moisture from the fabric back to the fabric front, and a first bra front 308 removed from the fabric 302 along a cutout edge 348 may maintain such moisture-wicking properties when sewn into a garment, such as a bra, having a fabric 302 front surface with a larger/coarser denier (50/72) compared to a fabric 302 back surface with a smaller/finer denier (30/36). The warp knitting process itself may provide for a specific positioning of bars of yarns used, such that a planar fabric 302 may include engineered features across various zones as well as textile differences on the front and back surfaces of the fabric 302. In one example of an engineered material 300 having multiple zones within a planar fabric 302, the first zone 312 (strap zone) and the second zone 314 (cup zone) include at least three bars of yarn: a macrofiber yarn (e.g., 50/72 polyester, 1×1 lapping) proximate a front side of the fabric, a microfiber yarn (e.g., 30/36, 1×3 lapping) proximate a second side of the fabric, opposite the first side, and a spandex yarn knitted with a pillar stitch throughout the material (e.g., a 70-denier spandex). Additionally, the third zone 316 (chestband) may include at least four bars of yarn: the 1×1 macrofiber yarn, 1×3 microfiber yarn, and pillar-stitch spandex of the first two zones, with the addition of an inlaid reinforcement yarn (i.e., a hard yarn, such as a 30/36 polyester).

The first zone 312 is constructed to provide an engineered lockout material along a first axis 322 and an engineered stretch material along the second axis 324. As such, a portion of the fabric 302 intended for extraction along the cutout edge 348, which will eventually become a portion of the straps for a finished bra, includes the first and second straps 342 and 344, knitted within the first zone 312 and exhibiting engineered material characteristics corresponding to both the yarn selection and stitch construction of the first zone 312. The first zone 312 may exhibit less elongation along the fabric width 304 (i.e., along the length of the first and second bra straps 342, 344) than along the fabric length 306 (i.e., along the width of the first and second bra straps 342, 344) based on one or more warp-knitted stitches within the first zone 312. In one aspect, the first zone 312 is engineered to provide a warp-knitted, engineered lockout material with between 15-25% elongation along the first axis 322 (i.e., along the fabric width 304). In another aspect, the first zone 312 is engineered to provide a warp-knitted, engineered lockout material with between 19-23% elongation along the first axis 322, while in further examples, an amount of elongation along the first axis 322 may be at or below 20%.

In contrast to the lockout along the first axis 322, the engineered stretch material along the second axis 324 may provide an amount of elongation greater than that along the first axis 322. In one example, the elongation along the second axis 324 may include a minimum amount of elongation at or above 40%. In further aspects, a minimum amount of elongation may be required for overall performance of the engineered material 300, such that once the first bra front 308 is combined with a bra back, the wearer of the assembled, engineered bra may be able to get the bra on and off without an additional closure mechanism. In some aspects, an engineered material having 40% or more elongation along the second axis 324 provides a threshold amount of fabric 302 movement within the first strap 342 and second strap 344 and across a width of the bra front 308, during both trying on/off, and during wear. As such, the engineered bra front 308 may provide a stabilizing function along the first axis 322 while at the same time providing a lockout function along the second axis 324. The different lockout and stretch properties of the resulting first bra front 308 may impact wear strength of a garment over time, aesthetic of the warp-knitted fabric front, ease of use when manipulating the overall body of the bra, and/or material resilience during activity.

In the exemplary top view of FIG. 19, a gradient patterning feature 346 corresponds to a common position on both the first strap 342 and the second strap 344. Such gradient patterning feature 346 may be created using a jacquard knit patterning technique to integrate one or more additional yarns within the first bra front 308. In some aspects, while the gradient patterning feature 346 may be integrally warp-knitted with the engineered material 300 having specific lockout characteristics along the first axis 322 and stretch characteristics along the second axis 324, the gradient patterning feature 346 may impact a percentage of elongation within a threshold range. For example, an increase or decrease in percentage of elongation associated with the gradient patterning feature 346 may correspond to a threshold amount of change in elongation to maintain up to 10% change in elongation.

Transitioning within the engineered material 300 and along the fabric width 304, the first zone 312 of the fabric 302 changes to an adjacent, second zone 314. In aspects, the fabric 302 within the second zone 314 includes one or more warp-knit stitches that are coupled to one or more warp-knitted stitches of the first zone 312. In other words, at least one stitch from the first zone 312 is knitted with at least one stitch from the second zone 314 along the band boundary 360. Each knit stitch along the band boundary may include yarn from one or both of the first zone 312 and the second zone 314. Similarly, a grouping of two or more wales within the fabric 302 may include a combination of knitted stitches from both the first zone 312 and the second zone 314. By joining stitches from the first zone 213 and the second zone 314, the engineered material 300 maintains multiple engineered-knit, zonal characteristics while the consistent fabric 302 is knit in a seamless transition between bra support features. As discussed below with respect to the third zone 316, fourth zone 318, and fifth zone 320, an engineered material 300 is generated within the seamless fabric 302 along the fabric width 304 and the fabric length 306, with banded features of bra support corresponding to particular zones arranged along the fabric width 306.

The seamless knit construction of the fabric 302 includes multiple transitions along the fabric width 304 that correspond to support function transitions along the bra length. The band boundary 360 is depicted in the example of FIG. 19 as a representation of a seamless transition between the yarn selection and/or stitch construction of the first zone 312 and the variable yarn selection and/or stitch construction of the second zone 314, and does not represent a material seam or intended cutout edge. Similarly, the subsequent band boundaries 362, 380, and 382 represent seamless material transitions across the warp-knitted fabric 302, with transitions in yarn type and/or stitch construction that generate the engineered material 300. Within the second zone 314, similar to the first zone 312, a first engineered bra front 308 includes a cup region of the first bra front 308 having an exemplary cutout edge 352 that defines the boundaries of the intended cutout, engineered bra front once removed from the fabric 302. The second zone 314 includes engineered stretch features corresponding to the fiber content of the yarn/yarns and a degree of lapping within the knitted courses and wales of the second zone 314. In some aspects, the number of bars used in warp knitting within the second zone 314, combined with a lapping configuration of particular yarns within the second zone 314, as well as the fiber content of the yarns on the bars used within the second zone 314, may be engineered to provide a threshold level of material elongation (i.e., threshold level of stretch) within the cup region of the bra front 308. In other words, an optimal level of elongation may be achieved to provide a particular bra function, such as the cup region support within the second zone 314.

The stretch/elongation characteristics within the second zone 314 correspond to one or more yarn selection and/or stitch construction characteristics within the second zone 314, such as a fiber content of one or more yarns warp-knitted to provide the cup region 350. As such, the second zone 314 may include a macrofiber/microfiber/spandex combination similar to that discussed above with respect to the first zone 312. The yarns within the second zone 314 are knitted to provide an engineered stretch portion for a bra cup region, having a threshold amount of stretch along the third axis 326 and the fourth axis 328. In some aspects, the cup region 350 is configured to minimize elongation along the third axis 326 (i.e., along the fabric width 304 and the length of the first bra front 308), with such elongation that supports volume of a wearer's breasts as well as accommodates molding of the fabric 302. Accordingly, while a degree of lockout is not desired, an amount of stretch provided within the second zone 314 may maintain a threshold level of elongation for both bra function/support, and material appearance.

The fabric 302 within the second zone 314 includes a non-patterned portion 356 of the fabric 302, without additional jacquard gradient patterning 354. In some examples, the fabric 302 may be engineered to provide a particular level of stretch based on yarn selection, knit construction, and/or a presence or absence of a jacquard patterned yarn. In some aspects, because the gradient patterning 354 is created by knitting holes in the front yarn to provide a graphic reveal of the back yarn, the non-patterned portion 356 may provide a higher-density region of the fabric 302 while the gradient patterning 354 may provide a less dense region of the fabric 302. Accordingly, an amount of gradient patterning 354 may impact elongation of the fabric 302 along one or more of the third axis 326 and the fourth axis 328. In the exemplary first bra front 308, the gradient patterning 346 and 354 may be positioned within the fabric 302 of the engineered material 300 with respect to a bra symmetry region 358, providing equal changes in elongation, lockout, and stretch corresponding to left (first strap 342) and right (second strap 344) sides of the bra front.

Aspects of the second zone 314 are constructed to provide an engineered stretch material along a third axis 326 and an engineered stretch material along a fourth axis 328. As such, a portion of the fabric 302 intended for extraction along the cutout edge 350 may eventually become a cup region of a finished bra, knitted with second zone 314 characteristics that correspond to both yarn selection and stitch construction, and that facilitate a threshold level of elongation such that engineered material of the cups may be molded. The cup region of the second zone 314 is also knitted to provide engineered knit construction that supports a wearer.

In one aspect, the second zone 314 is engineered to provide a warp-knitted, engineered stretch material with 35-45% elongation along both the third axis 326 and the fourth axis 328. In another example, the second zone 314 includes 40% elongation in at least a portion of the cup region. The gradient patterning 354 within the second zone 314 may be created using a jacquard knitting technique to change a location of one or more yarns with respect to the symmetry boundary 358. The cup region of the first bra front 318 includes an amount of inherent stretch within the fabric 302 due to the knit structure of the engineered material 300. Accordingly, additional knitting and/or gradient patterning techniques may be included within the second zone 314 to impact an amount of stretch along the fabric width 304 (i.e., along the bra length). Along the banded boundary 362, the engineered material 300 shifts from a second portion (second zone 312) of the fabric 302 to a fourth second zone 314. As such transition is made, an amount of gradient patterning 368 increases along a supporting chestband 364

Transitioning within the engineered material 300 and along the fabric width 304, the second zone 314 of the fabric 302 changes to an adjacent, third zone 316. In aspects, the fabric 302 associated with the third zone 316 includes one or more warp-knit stitches (wales of stitches) that are coupled to one or more warp-knitted stitches (wales of stitches) of the second zone 314. In other words, at least one stitch from the second zone 314 is knitted with at least one stitch from the third zone 316 along the band boundary 362. Each knit stitch along the band boundary 362 may include yarn from one or both of the second zone 314 and the third zone 316. Within a portion of the third zone 316, a chestband region 364 of the first bra front 308 may include a cutout edge 370 that designates a boundary for removal of the first bra front 308 from the fabric 302. The third zone 316 may be generally referred to as having a lockout characteristic along the fifth axis 330 and a lockout characteristic along the sixth axis 332, thereby restricting the elongation of yarns within the third zone 316, and within the band region 364. In some aspects, the lockout characteristics along the first axis 322 may be the same or similar to the lockout characteristics along the fifth axis 330 and sixth axis 332.

Similar to the exemplary layout of the first and second zones 312, 314, banded features of bra support, such as a chestband region 364, correspond to the third zone 316 arranged along the fabric width 304. In some aspects, the warp-knit construction within the bands of the engineered material 300 includes parallel zones along the y axis of the fabric 302, which allows for variable lockout and stretch characteristics oriented along the fabric 302 with respect to the fabric width 304 and fabric length 306. The third zone 316 is constructed to provide an engineered lockout material along both a fifth axis 330 and a sixth axis 332. As such, a portion of the fabric 302 intended for extraction along the cutout edge 370 will eventually become a portion of the chestband region for a finished bra, exhibiting engineered material characteristics corresponding to both the yarn selection and stitch construction of the third zone 316.

In one aspect, the third zone 316 may exhibit a threshold lockout elongation along the fabric width 304 (i.e., along a chestband height when in an upright orientation) and a threshold lockout elongation along fabric length 306 (i.e., along the chestband width when in an upright orientation) based on one or more warp-knitted stitches within chestband region 364 of the third zone 316. In one aspect, the third zone 316 is engineered to provide a warp-knitted, engineered lockout material with between 15-25% elongation along both the fifth and sixth axis 330, 332 (i.e., along the fabric width 304). In another aspect, the third zone 316 is engineered to provide a warp-knitted, engineered lockout material with between 19-23% elongation along both the fifth and sixth axis 330, 332, while in further examples, an amount of elongation along the fifth and/or sixth axis 330 may be at or below 20%. As such, a maximum elongation threshold may be established along both the fifth axis 330 and the sixth axis 332 to stabilize the chestband region 364, prevent movement of the wearer's bra, and maintain the engineered bra material in a desired position on a wearer's body once the first bra front 308 is extracted from the fabric 302 and sewn into an assembled bra formation.

In the exemplary top view of FIG. 19, a gradient patterning feature 368 corresponds to the gradient patterning feature 346, and may be created using a jacquard knit patterning technique to manipulate one or more yarns within the first bra front 308. In some aspects, the gradient patterning feature 368 may impact a percentage of elongation within a threshold range. For example, an increase or decrease in percentage of elongation associated with the gradient patterning feature 368 may correspond to a threshold amount of change in elongation to maintain up to 10% change in elongation from an original lockout engineered material having between 19-23% elongation. In some aspects, in addition to changes in yarn content and/or position on the warp-knitting beams, and stitch construction during the knitting process via lapping techniques, a targeted location for gradient patterning features may be used to supplement a variable amount of elongation within the first bra front 308, and between the various engineered zones of the fabric 302.

Referring briefly to the second bra front 310 oriented lengthwise along the fabric width 304 (and widthwise along the fabric length 306), a mirrored zonal construction within the fabric 302 is configured to provide an additional engineered bra within the segment of engineered material 300. In some aspects, the fabric left side 400 and fabric right side 398 correspond to selvedge edges of the warp-knitted fabric 302, with the upper edge 394 working edge (i.e., proximate the warp beams) opposite the lower edge 396 of the knitted fabric 302. Further, similar strap, cup, and chestband features are engineered within the fabric 302 in an orientation mirroring the first bra 308, as shown in the example of FIG. 19. Based on positioning within the third zone 316, the chestband region 366 of the second bra front 310 may include the same engineered lockout features of the fabric 302 as oriented along the fifth axis 330 and sixth axis 332.

In one example, the third zone 316 is adjacent a fourth zone 318 having the same or similar engineered stretch characteristics as those described with respect to the second zone 314. As such, the cup region 372 of the second bra front 310 may include a cutout edge 374, gradient patterning 376 oriented with respect to a symmetry boundary 378, and engineered stretch characteristics along the seventh axis 334 and eighth axis 336. Continuing along the fabric width 304 and adjacent the fourth zone 318 along the band boundary 382, the fabric 302 may also include a fifth zone 320 having the same or similar engineered stretch characteristics as those described with respect to the first zone 312. In one example, the third strap 386 and fourth strap 388 of the second bra front 310 may include a cutout edge 390 along which each of the straps may be removed from the fabric 302, gradient patterning 392, engineered lockout characteristics along the ninth axis 338, and engineered stretch characteristics along the tenth axis 340. Some aspects of the engineered material 300 include a fabric 302 having a fabric width 304 that accommodates a single bra front 308, while in the embodiment of FIG. 19, the fabric 302 includes a fabric width 304 that facilitate warp knitting of at least two bra fronts having a similar configuration as in the example of FIG. 19.

Figure 20:
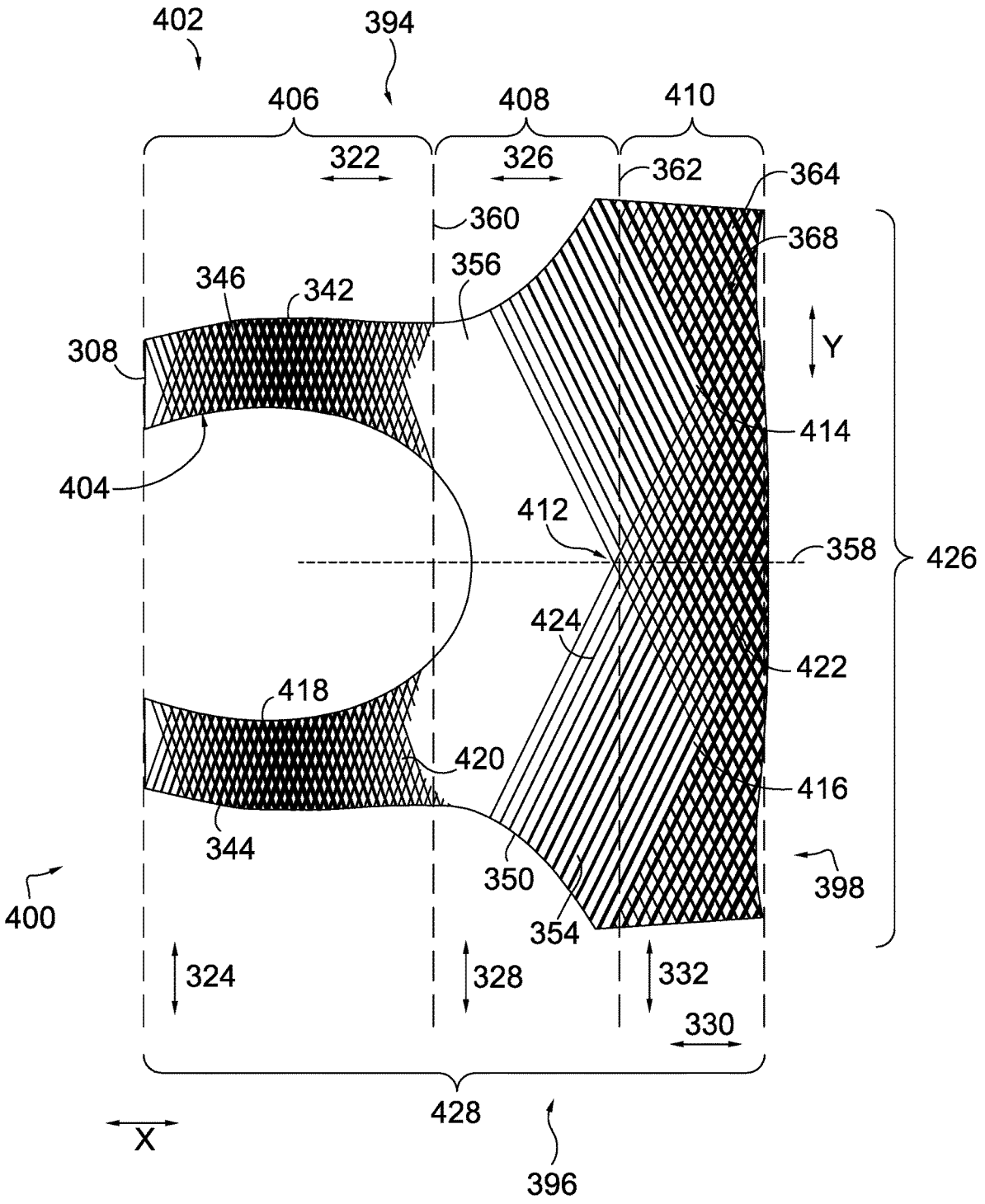
FIG. 20 illustrates a cut-out bra front of the engineered knit bra material of FIG. 19, in accordance with an aspect herein.

Turning next to FIG. 20, a cut-out bra front 400 of the engineered knit bra material of FIG. 19 may include an engineered material 402 having a cutout border 404, an upper knitting edge 394, a knitted edge 396, a bottom bra edge 398, a first zone 406 adjacent a second zone 408, and a third zone 410 (adjacent the second zone 408) across the bra front length 428 and the bra front width 426. In this example, midline convergence point 412 is depicted along the symmetry boundary 358, with a left bust convergence point 414 opposite a right bust convergence point 416, each of which correspond to an orientation of gradient patterning within different portions of the bra front 400. In some aspects, various gradient patterns of jacquard knitting within the bra front 400 may include dense patterning 418 and 422 that transition to a spaced patterning 420 and 424 (i.e., less dense). Such variations in gradient patterns throughout the warp-knitted, cut-out bra front 400 may enhance or diminish an amount of elongation, lockout, stretch, color appearance, yarn transparency, etc.

Figure 21:
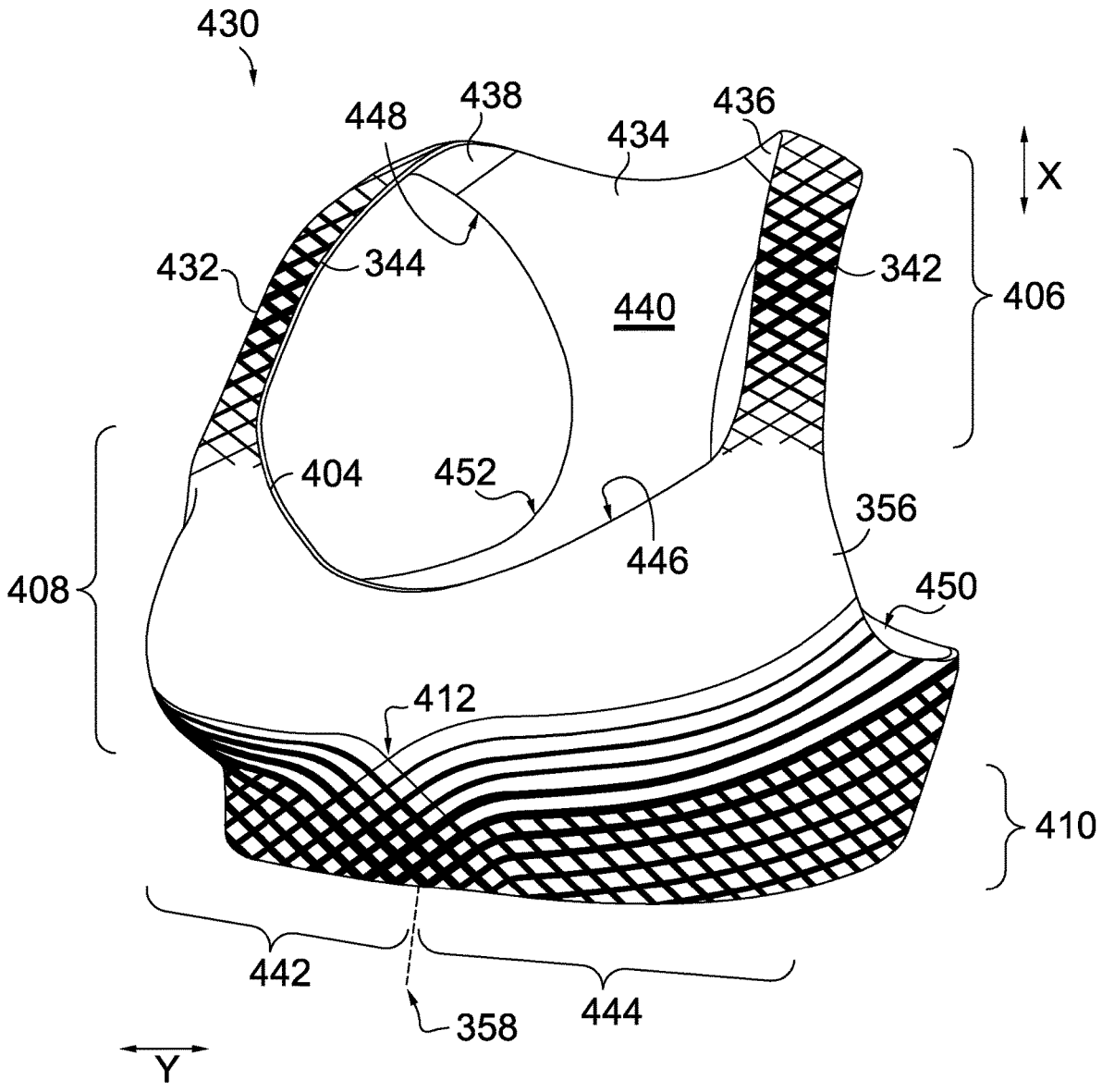
FIG. 21 illustrates a front, perspective view of an assembled, engineered knit bra with preconfigured lockout and stretch zones, in accordance with an aspect herein.

With reference to FIG. 21, an assembled, engineered knit bra 430 includes preconfigured lockout and stretch zones, such as the first zone 406 (lockout along bra length, stretch along bra width), second zone 408 (stretch in both length and width), and third zone 410 (lockout in both length and width). The assembled, engineered knit bra 430 includes an engineered bra front 432 coupled to a bra back 434, such as a mesh material 440, coupled at the upper seams 436 and 438 to provide a zonal support bra having a first moldable bust zone 442, a second moldable bust zone 444, a neckline edge 446, armhole edges 448, and side seams 450 and 452, in accordance with an aspect herein. The example of FIG. 21 depicts a seamless banded construction with respect to the engineered bra front 432, providing locked-out bra straps along a strap length, an expandable cup structure, and a locked out chestband region, with each of the first zone 406, second zone 408, and third zone 410 having integral engineered construction to provide a specific bra-support function without assembling multiple pieces of the engineered bra front 432. As such, aspects of the assembled engineered bra 430 include banding of specific yarn content and stitch construction within such zones, and across a width of the engineered bra front 432, that provide a particular support function without additional assembly other than the coupling of a bra back 434.

Figure 22:
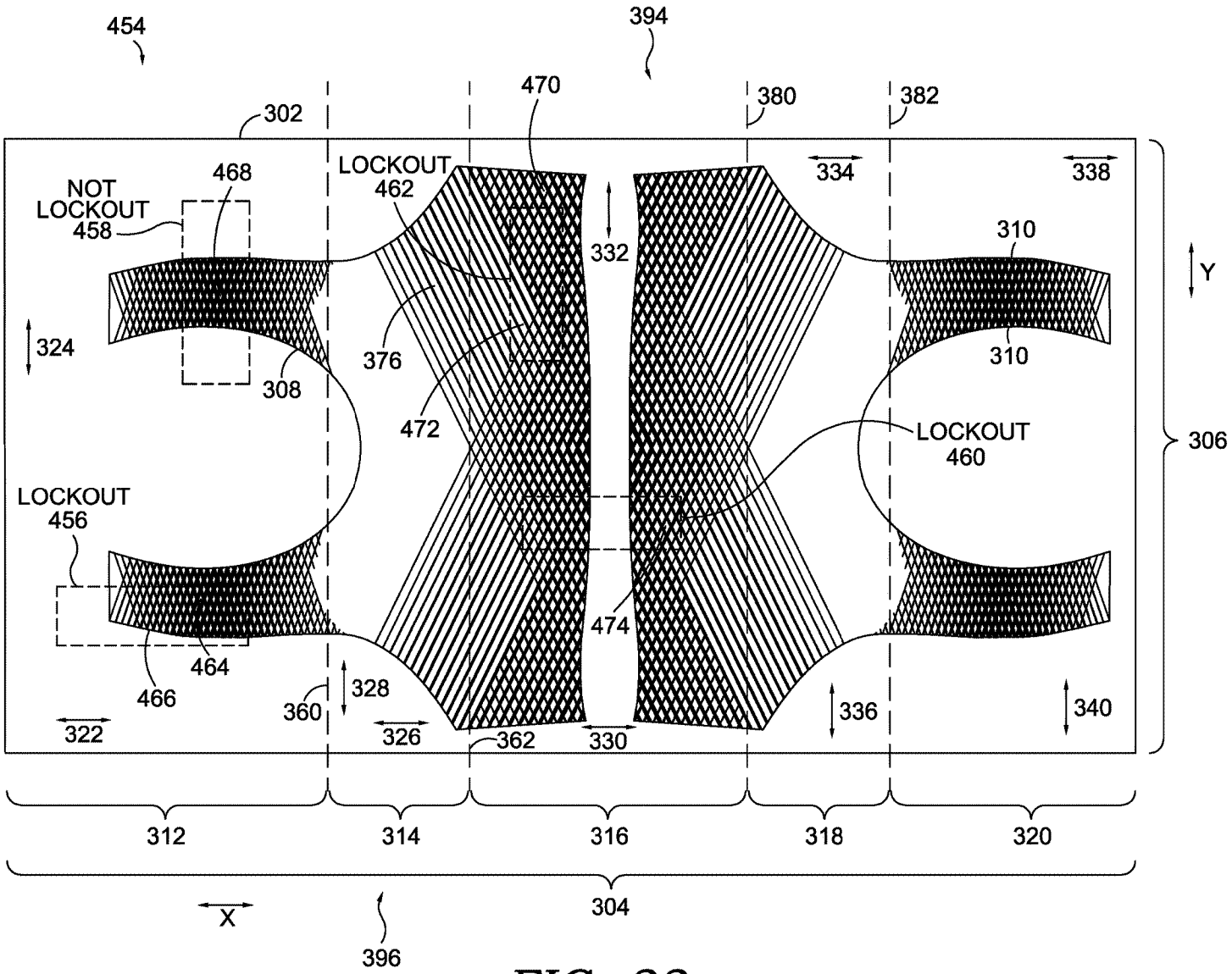
FIG. 22 illustrates a top view of an exemplary engineered knit bra material having preconfigured lockout and stretch zones corresponding to exemplary test zones, in accordance with an aspect herein.

Referring next to FIG. 22, a top view of an exemplary engineered knit bra material 454 having preconfigured lockout and stretch zones corresponding to exemplary test zones, includes a first test zone 456, a second test zone 458, a third test zone 474, and a fourth test zone 462. The material 454 of FIG. 22 corresponds to the engineered material 300 of FIG. 19, by virtue of the banded zones and location of elongation and lockout characteristics. For example, the first test zone 456 may be used to identify engineered lockout characteristics 466 associated with the engineered material 454 and/or the gradient patterning 464. Based on yarn selection and stitch construction, first test zone 456 includes a lockout engineered characteristic along the x axis (fabric width 304) while second test zone 458 includes a stretch/elongation characteristic along the y axis (fabric length 306). Additional test zones for the engineered knit bra material 454 may include the third test zone 474 and fourth test zone 462 corresponding to multidirectional lockout in the chestband.

In some instances, a first knit zone that exhibits a first modulus of elasticity within a predefined range along a first direction 322, may include a first modulus of elasticity associated with elongation between 10-30%. In other aspects, the first knit zone exhibits between 15-25% elongation along the first direction, while in further aspects, the first knit zone exhibits between 20-25% elongation along the first direction. In other aspects, the first knit zone may further include a second modulus of elasticity within a predefined range along a second direction 324, with the second modulus of elasticity associated with elongation between 15-40%. In some aspects, the first knit zone exhibits between 20-35% elongation, while in other aspects, the first knit zone exhibits less than 30% elongation along the second direction.

In further aspects, a second knit zone that exhibits a third modulus of elasticity within a predefined range along the first direction 326 may include a second modulus of elasticity between 15-35. In further aspects, the second knit zone exhibits between 20-30% elongation, while in other aspects, the second knit zone exhibits between 23-27% elongation along the first direction. In other aspects, the second knit zone may further include a fourth modulus of elasticity within a predefined range along the second direction 328, with the fourth modulus of elasticity between 100 and 200% elongation. In some instances, the fourth modulus of elasticity is between 125-175% elongation, while in further aspects, the elongation along the second direction within the second knit zone is between 140-160% elongation.

In some aspects, a third knit zone that exhibits a fifth modulus of elasticity within a predefined range along the first direction 330 may include a fifth modulus of elasticity between 10-30%. In other aspects, the fifth knit zone exhibits between 15-25% elongation along the first direction, while in further aspects, the third knit zone exhibits between 20-25% elongation along the first direction. Additionally, aspects of the third knit zone include a sixth modulus of elasticity within a predefined range along the second direction 332, with the sixth modulus of elasticity between 20-50% elongation. In some aspect, the third knit zone includes between 30-45% elongation, while in other aspects, the percent elongation includes between 30-40%.

Aspects of the engineered knit bra discussed with respect to FIGS. 19-22 may be summarized according to one or more construction parameters used to generate the engineered material, such as the example of FIG. 23 showing an exemplary warp-knit layout 476. In this example, the warp-knit layout 476 includes multiple bars 478 of yarns 480 having specific fiber content 482, which may vary across the multiple bra zones 484 discussed above. For example, the bra straps 486, cup 88, and chestband 490 may include two bars of 50/72 polyester yarn with 1×1 lapping, one bar of 30/36 yarn with 1×3 lapping, and a 70-D spandex knitted throughout with a pillar stitch. Further, the chestband region may utilize the same 50/72, 30/36, and 70-D yarns, in addition to a 30/36 polyester that is laid in. As discussed in more detail above, such numerical values for the zonal yarns of the warp-knit layout 476 may vary in denier size and filament count, and satisfy the warp-knit layout thresholds based on a minimum range of satisfactory engineered features.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

What is claimed is:

1. An engineered bra comprising:

a warp-knit panel having a front face and a back face, the warp-knit panel comprising:

a first knit zone comprising a first plurality of warp-knitted yarns forming at least a pair of bra straps having a strap length in a first direction and a strap width in a second direction and having a first modulus of elasticity along the first direction and a second modulus of elasticity along the second direction, the second modulus of elasticity providing greater elongation than the first modulus of elasticity;

a second knit zone comprising a second plurality of warp-knitted yarns forming bra cups and having a third modulus of elasticity along the first direction and a fourth modulus of elasticity along the second direction, the third modulus of elasticity and the fourth modulus of elasticity each providing greater elongation than the first modulus of elasticity, wherein a yarn of the second plurality of warp-knitted yarns is interlocked with a yarn of the first plurality of warp-knitted yarns; and a third knit zone comprising a third plurality of warp-knitted yarns forming at least part of a chestband, the third knit zone having a fifth modulus of elasticity along the first direction, the third knit zone comprising an inlaid yarn and having a sixth modulus of elasticity along the second direction, the fifth modulus of elasticity and the sixth modulus of elasticity each providing less elongation than the second modulus of elasticity, wherein a yarn of the third plurality of warp-knitted yarns is interlocked with a yarn of the second plurality of warp-knitted yarns.

2. The engineered bra of claim 1, wherein each of the bra straps, the bra cups, and the chestband corresponds to a particular support function when the engineered bra is in an as-worn configuration.

3. The engineered bra of claim 1, wherein each of the first plurality of warp-knitted yarns, the second plurality of warp-knitted yarns, and the third plurality of warp-knitted yarns comprises a spandex yarn warp knitted in a pillar stitch configuration within each of the first knit zone, the second knit zone, and the third knit zone.

4. The engineered bra of claim 1, wherein the third modulus of elasticity and the fourth modulus of elasticity each provide a percent of elongation within a range of 35% to 45%.

5. An engineered bra comprising:

a warp-knit panel having a front face and a back face, the warp-knit panel comprising:

a knitted strap zone comprising a plurality of warp-knitted strap zone yarns forming a pair of bra straps having a strap length in a first direction and a strap width in a second direction, wherein the knitted strap zone comprises a first modulus of elasticity along the first direction providing a percent of elongation at or below 20%, the knitted strap zone further comprising a second modulus of elasticity along the second direction that provides a percent of elongation at or above 40%;

a knitted cup zone comprising a plurality of warp-knitted cup zone yarns forming bra cups, wherein the knitted cup zone comprises a third modulus of elasticity along the first direction and a fourth modulus of elasticity along the second direction, the third modulus of elasticity and the fourth modulus of elasticity each providing more elongation than the first modulus of elasticity, and wherein a yarn of the plurality of warp-knitted strap zone yarns is interlocked with a yarn of the plurality of warp-knitted cup zone yarns; and a knitted chestband zone comprising a plurality of warp-knitted chestband zone yarns forming at least part of a chestband, wherein the knitted chestband zone comprises an inlaid hard yarn, the knitted chestband zone comprising a fifth modulus of elasticity along the first direction and having a sixth modulus of elasticity along the second direction, the fifth modulus of elasticity and the sixth modulus of elasticity each providing less elongation than the second modulus of elasticity, wherein a yarn of the plurality of warp-knitted chestband zone yarns is interlocked with a yarn of the plurality of warp-knitted cup zone yarns.

6. The engineered bra of claim 5, wherein each of the plurality of warp-knitted strap zone yarns, the plurality of warp-knitted cup zone yarns, and the plurality of warp-knitted chestband zone yarns comprises one or more engineered features that modify a modulus of elasticity value of the respective knitted strap zone, the knitted cup zone, and the knitted chestband zone.

7. The engineered bra of claim 5, wherein the knitted cup zone is adapted to be located over a breast cup area of a wearer when the engineered bra is in an as-worn configuration.

8. An engineered bra comprising:

a warp-knit panel having a front face and a back face, the warp-knit panel comprising:

a strap zone having a plurality of strap zone yarns warp knitted in the engineered bra to form at least a pair of bra straps having a strap length in a first direction and a strap width in a second direction, the strap zone comprising a first modulus of elasticity along the first direction providing a first percent of elongation at or below 20%, the strap zone further including a second modulus of elasticity along the second direction providing a second percent of elongation at or above 40%, the plurality of strap zone yarns comprising front yarn content and back yarn content;

a cup zone having a plurality of cup zone yarns warp knitted in the engineered bra to form bra cups and having a third modulus of elasticity along the first direction and a fourth modulus of elasticity along the second direction, the third modulus of elasticity and the fourth modulus of elasticity each providing greater elongation than the first modulus of elasticity, and wherein the plurality of cup zone yarns comprising 1×1-lapped front yarn content and 1×3-lapped back yarn content; and a chestband zone having a plurality of chestband zone yarns warp knitted in the engineered bra to form at least part of a chestband, the chestband zone comprising a laid-in hard yarn, the chestband zone comprising a fifth modulus of elasticity along the first direction and a sixth modulus of elasticity along the second direction, the fifth modulus of elasticity and the sixth modulus of elasticity each providing less elongation than the second modulus of elasticity, the plurality of chestband zone yarns comprising 1×1-lapped front yarn content and 1×3-lapped back yarn content;

wherein a strap zone yarn is interlocked with a cup zone yarn, and a cup zone yarn is interlocked with a chestband zone yarn.

9. The engineered bra of claim 8, wherein the front yarn content comprises a polyester yarn having a first denier per filament (DPF), and wherein the back yarn content comprises a polyester yarn having a second DPF less than the first DPF such that moisture is transferred from a bra back side toward a bra front side.

10. The engineered bra of claim 8, wherein each of the plurality of strap zone yarns, the plurality of cup zone yarns, and the plurality of chestband zone yarns comprises a spandex yarn in a pillar stitch construction throughout the engineered bra.

11. The engineered bra of claim 8, wherein at least one of the third modulus of elasticity and the fourth modulus of elasticity provide elongation within a range of 35% to 45%.

12. The engineered bra of claim 1, wherein the fifth modulus of elasticity and the sixth modulus of elasticity each provide a percent of elongation between 15% to 25%.

13. The engineered bra of claim 1, wherein the fifth modulus of elasticity and the sixth modulus of elasticity each provide a percent of elongation that is 20% or less.

14. The engineered bra of claim 1, wherein the first modulus of elasticity provides less than or equal to 20% elongation.

15. The engineered bra of claim 14, wherein the second modulus of elasticity provides greater than or equal to 40% elongation.

16. The engineered bra of claim 1, wherein the second knit zone comprises a patterned portion comprising knitted-in holes in the front face that reveal the back face and a portion without knitted-in holes, the patterned portion of the second knit zone having a different amount of elongation than the portion without the knitted-in holes in one or more of the first direction and the second direction.

17. The engineered bra of claim 5, wherein the knitted cup zone comprises a patterned portion comprising knitted-in holes in the front face that reveal the back face and a portion without knitted-in holes, the patterned portion of the knitted cup zone having a different amount of elongation than the portion without the knitted-in holes in one or more of the first direction and the second direction.

18. The engineered bra of claim 8, wherein the cup zone comprises a patterned portion comprising knitted-in holes in the front face that reveal the back face and a portion without knitted-in holes, the patterned portion of the cup zone having a different amount of elongation than the portion without the knitted-in holes in one or more of the first direction and the second direction.

* * * * *